US010466640B2

(12) United States Patent
Isohara

(10) Patent No.: US 10,466,640 B2
(45) Date of Patent: Nov. 5, 2019

(54) IMAGE FORMING SYSTEM

(71) Applicant: KONICA MINOLTA, INC., Chiyoda-ku, Tokyo (JP)

(72) Inventor: Hideo Isohara, Fuchu (JP)

(73) Assignee: KONICA MINOLTA, INC., Tokyo (JP)

( * ) Notice: Subject to any disclaimer, the term of this patent is extended or adjusted under 35 U.S.C. 154(b) by 7 days.

(21) Appl. No.: 15/845,221

(22) Filed: Dec. 18, 2017

(65) Prior Publication Data

US 2018/0173150 A1 Jun. 21, 2018

(30) Foreign Application Priority Data

Dec. 19, 2016 (JP) ..... 2016-245743

(51) Int. Cl.
*B65H 7/20* (2006.01)
*G03G 15/00* (2006.01)
*G03G 15/23* (2006.01)

(52) U.S. Cl.
CPC ..... *G03G 15/70* (2013.01); *G03G 15/5008* (2013.01); *G03G 15/55* (2013.01); *G03G 15/602* (2013.01); *G03G 15/6564* (2013.01); *B65H 7/20* (2013.01); *G03G 15/238* (2013.01); *G03G 2215/00021* (2013.01); *G03G 2215/00341* (2013.01)

(58) Field of Classification Search
CPC ..... G03G 2215/00021; G03G 15/6564; B65H 7/20
See application file for complete search history.

(56) References Cited

U.S. PATENT DOCUMENTS

2011/0150520 A1* 6/2011 Kasahara ..... G03G 15/238 399/76
2012/0099152 A1* 4/2012 Kamata ..... G06K 15/12 358/1.15
2013/0028645 A1* 1/2013 Dobbertin ..... G03G 15/238 399/364
2015/0063848 A1* 3/2015 Ikuta ..... G03G 15/6564 399/45

FOREIGN PATENT DOCUMENTS

JP 2003167485 A 6/2003

OTHER PUBLICATIONS

Extended European Search Report corresponding to Application No. 17203297.1-1022; dated Jul. 31, 2018.

* cited by examiner

*Primary Examiner* — Howard J Sanders
(74) *Attorney, Agent, or Firm* — Cantor Colburn LLP

(57) ABSTRACT

An image forming system includes a first device and a second device that are connected in series. The first device can continuously discharge a paper. The second device is blocked from information on a paper conveyance in the first device. The second device, based on printing setting information and a time at which the first paper passes the predetermined position, sets a printing cycle, and based on a time at which the second paper passes the predetermined position, calculates a delay time from a printing cycle of the second paper. The second device stops a conveyance of the second paper that is conveyed to the paper processor, and in accordance with the delay time, controls resuming of the stopped conveyance of the second paper.

12 Claims, 14 Drawing Sheets

IMAGE FORMING SYSTEM

CROSS-REFERENCE TO RELATED APPLICATION

The present invention claims priority under 35 U.S.C. § 119 to Japanese Patent Application No. 2016-245743, filed on Dec. 19, 2016, the entire contents of which is incorporated herein by reference.

BACKGROUND

1. Technological Field

The present invention relates to an image forming system.

2. Description of the Related Art

In recent years, in the field of the production print (hereinafter, also referred to as "PP"), a technique for increasing the speed and enhancing the efficiency of the printing process has been developed. As one of the techniques for increasing the speed and enhancing the efficiency of the printing process, it is generally known an image forming apparatus of a series tandem system obtained by connecting two image forming apparatus which are operable alone in series. In the present description, among the image forming apparatuses of the series tandem system, an image forming apparatus located at an upstream side in the paper conveyance direction is referred to as an "upstream apparatus," and an image forming apparatus located at a downstream side is referred to as a "downstream apparatus."

In the field of the PP, the "image forming system" is configured by connecting a paper feeder which can supply a large amount of papers to the image forming apparatus of the series tandem system and a post-processing device which performs the post-processing on the paper formed with images to correspond to commercial printings to which a large amount of printing processes are required in a short period of time.

In the image forming system, to suppress the paper jam and maintain the productivity, for the upstream apparatus, the downstream apparatus and the post-processing device, it is important to make constant the intervals of the conveyed paper as much as possible, i.e., keep constant the printing cycles of the upstream apparatus and the downstream apparatus. However, between the upstream apparatus and the downstream apparatus, by unpredictable factors such as the friction between the paper and the paper conveying path and the slipping of the paper relative to the conveying roller, a delay may occur to the paper which is conveyed from the upstream apparatus to the downstream apparatus.

Relevantly, for example, Japanese Patent Application Laid-Open No. 2003-167485 discloses a technique of realizing the synchronization of the printing cycles of the surface and the back surface when an image forming unit of the image forming apparatus forms an image on the surface of the paper, the paper is reversed to be supplied to the image forming unit, and the image is formed to the back surface of the paper. In Japanese Patent Application Laid-Open No. 2003-167485, to perform the two-sided printing in a single image forming apparatus, it is possible to easily realize the synchronization of the printing cycles of the surface and the back surface by obtaining information on the paper conveyance of printing the surface when the back surface is printed.

On the other hand, in the image forming system including the upstream apparatus and the downstream apparatus, since a configuration for exchanging the information on the paper conveyance is not provided between the upstream apparatus and the downstream apparatus, the downstream apparatus may not acquire the information on the paper conveyance at the upstream apparatus. Although it is possible to newly add a configuration for exchanging the information on the paper conveyance between the upstream apparatus and the downstream apparatus, it is possible that the significant cost occurs and it is not realistic.

As described above, in the image forming system, it is difficult for the downstream apparatus to acquire the information on the paper conveyance at the upstream apparatus, and thus, it is not easy to realize the synchronization of the printing cycles between the upstream apparatus and the downstream apparatus. Unless the synchronization of the printing cycle is realized between the upstream apparatus and the downstream apparatus, when the delay in the paper occurs, the deviation in the printing cycle of the downstream apparatus occurs. Further, when the delay is also caused at the succeeding paper, the delay time of the paper at the downstream apparatus is increased and defects such as paper jam may be caused.

To handle such a situation, for example, there is a method in which assuming the delay of the paper from the upstream apparatus, the downstream apparatus delays the start of printing to absorb the delay of the paper from the upstream apparatus, and printing cycles of the upstream apparatus and the downstream apparatus are kept constant. However, this causes a problem that the printing cycle of the downstream apparatus is delayed, the producing capability originally equipped with the upstream apparatus and the downstream apparatus may not be sufficiently exerted, and the productivity of the printing process is lowered.

SUMMARY

The present invention is made in view of the above problem. Accordingly, the objects of the present invention are to provide the image forming system that, even if the information on the paper conveyance is blocked between the upstream apparatus and the downstream apparatus, can prevent or suppress the deviation of the synchronization of the printing cycle while maintaining the productivity of the printing process.

To achieve at least one of the above-mentioned objects, according to an aspect of the present invention, an image forming system reflecting one aspect of the present invention comprises: a first device which can continuously discharge the paper and a second device which is located at a downstream side in the paper conveyance direction relative to the first device and is blocked from the information on the paper conveyance at the first device. The second device comprises: a paper introducer that introduces a plurality of papers including a first paper that is discharged from the first device and a second paper that follows the first paper; a hardware processor that acquires information on printing setting of the paper from the first device; a paper processor that performs predetermined processes on the paper; a paper conveyer that includes a paper conveying path and conveys the paper along the paper conveying path from the paper introducer to the paper processor; a paper detector that is provided to a predetermined position of the paper conveying path that extends from the paper introducer to the paper processor and detects the paper that passes the predetermined position; a print cycle calculator that, based on the information on the printing setting of the first paper and a time at which the first paper passes the predetermined position, sets the printing cycle that serves as a reference of the timing at which the paper processor starts the predetermined processes on the paper; a delay time calculator that, based on the printing cycle and a time at which the second paper passes the predetermined position, calculates a delay time from the printing cycle of the second paper; and a conveyance controller that stops conveyance of the second paper that is conveyed toward the paper processor and controls resuming of the stopped conveyance of the second paper depending on the delay time.

To achieve at least one of the above-mentioned objects, according to an aspect of the present invention, an image forming system reflecting one aspect of the present invention comprises: the first device that can continuously discharge the paper and the second device that is located at the downstream side in the paper conveyance direction relative to the first device and is blocked from the information on the paper conveyance at the first device. The second device comprises: the paper introducer that introduces a plurality of papers including the first paper that is discharged from the first device and the second paper that follows the first paper; the hardware processor that acquires the information on printing setting of the paper from the first device; the paper processor that performs predetermined processes on the paper; the paper conveyer that includes the paper conveying path and conveys the paper along the paper conveying path from the paper introducer to the paper processor; the paper detector that is provided to a predetermined position of the paper conveying path that extends from the paper introducer to the paper processor and detects the paper that passes the predetermined position; the print cycle calculator that, based on the information on printing setting of the first paper and a time at which the first paper passes the predetermined position, sets the printing cycle that serves as a reference of the timing at which the paper processor starts the predetermined processes on the paper; the delay time calculator that, based on the printing cycle and a time at which the second paper passes the predetermined position, calculates the delay time from the printing cycle of the second paper; and the conveyance controller that changes a conveyance speed of the second paper conveyed toward the paper processor depending on the delay time.

To achieve at least one of the above-mentioned objects, according to an aspect of the present invention, an image forming system reflecting one aspect of the present invention comprises: the first device that can continuously discharge the paper, the second device that is located at the downstream side in the paper conveyance direction relative to the first device and is blocked from the information on the paper conveyance at the first device, and an intermediate conveying device that is located between the first device and the second device. The intermediate conveying device comprises: an intermediate paper introducer that introduces a plurality of papers including the first paper that is discharged from the first device and a second paper that follows the first paper; a paper discharger that discharges the plurality of papers; an intermediate paper conveyer including an intermediate paper conveying path and a plurality of pairs of conveying rollers that are provided to the intermediate paper conveying path and are driven by individually independent drive source to convey the paper, along the intermediate paper conveying path, from the intermediate paper introducer to the paper discharger; and a paper detector that is provided to a predetermined position of the intermediate paper conveying path that extends from the intermediate paper introducer to the paper discharger and detects the paper that passes the predetermined position; and the second device comprises: the paper introducer that introduces the plurality of papers that are discharged from the intermediate conveying device; the hardware processor that acquires the information on printing setting of the paper from the first device; the paper processor that performs predetermined process on the paper; the paper conveyer that includes the paper conveying path and conveys the paper, along the paper conveying path, from the paper introducer to the paper processor; the print cycle calculator that, based on the information on printing setting of the first paper and a time at which the first paper passes the predetermined position, calculates the printing cycle that serves as a reference of the timing at which the paper processor starts the predetermined processes on the paper; the delay time calculator that, based on the printing cycle and a time at which the second paper passes the predetermined position, calculates the delay time from the printing cycle of the second paper; and a conveyance controller that increases a conveyance speed of the second paper by rotating the plurality of pairs of conveying roller such that the paper processor can synchronize with the printing cycle to start the predetermined processes on the second paper.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Figure 1:
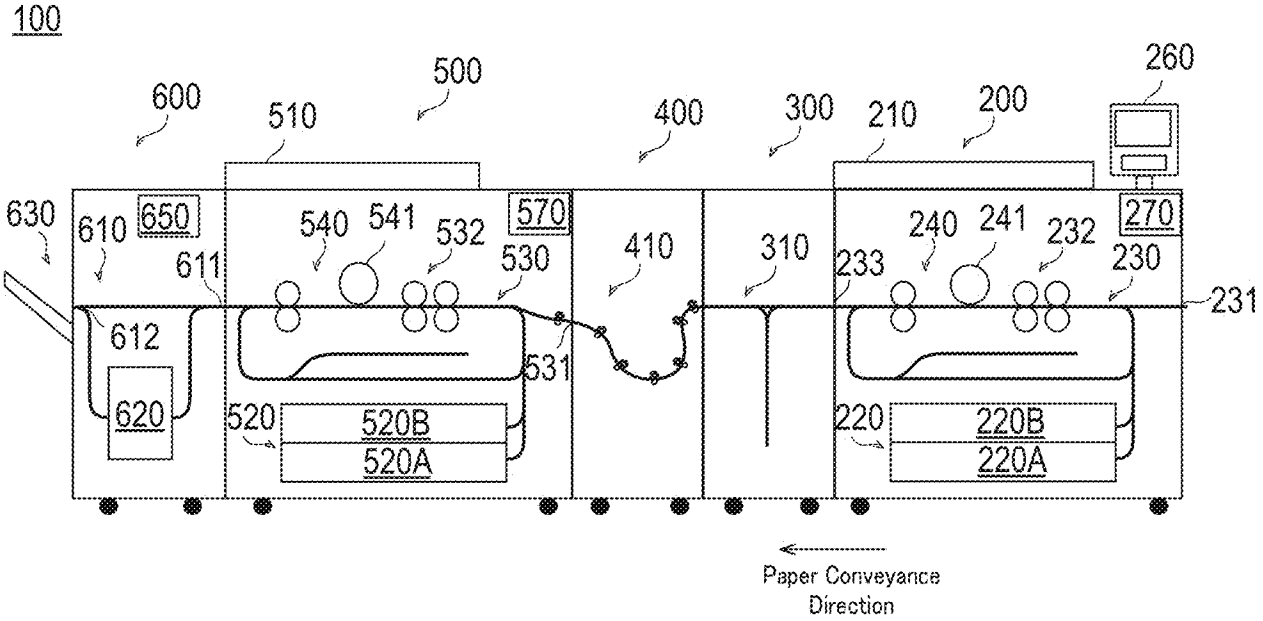
FIG. 1 is a schematic cross-sectional view exemplifying a configuration of an image forming system according to a first embodiment.

Hereinafter, one or more embodiments of the present invention will be described with reference to the drawings. However, the scope of the invention is not limited to the disclosed embodiments. In drawings, an identical member is denoted with an identical reference numeral. The size ratios in the drawings are exaggerated for the convenience of the description and are often different from actual ratios.

(First Embodiment)

Figure 2:
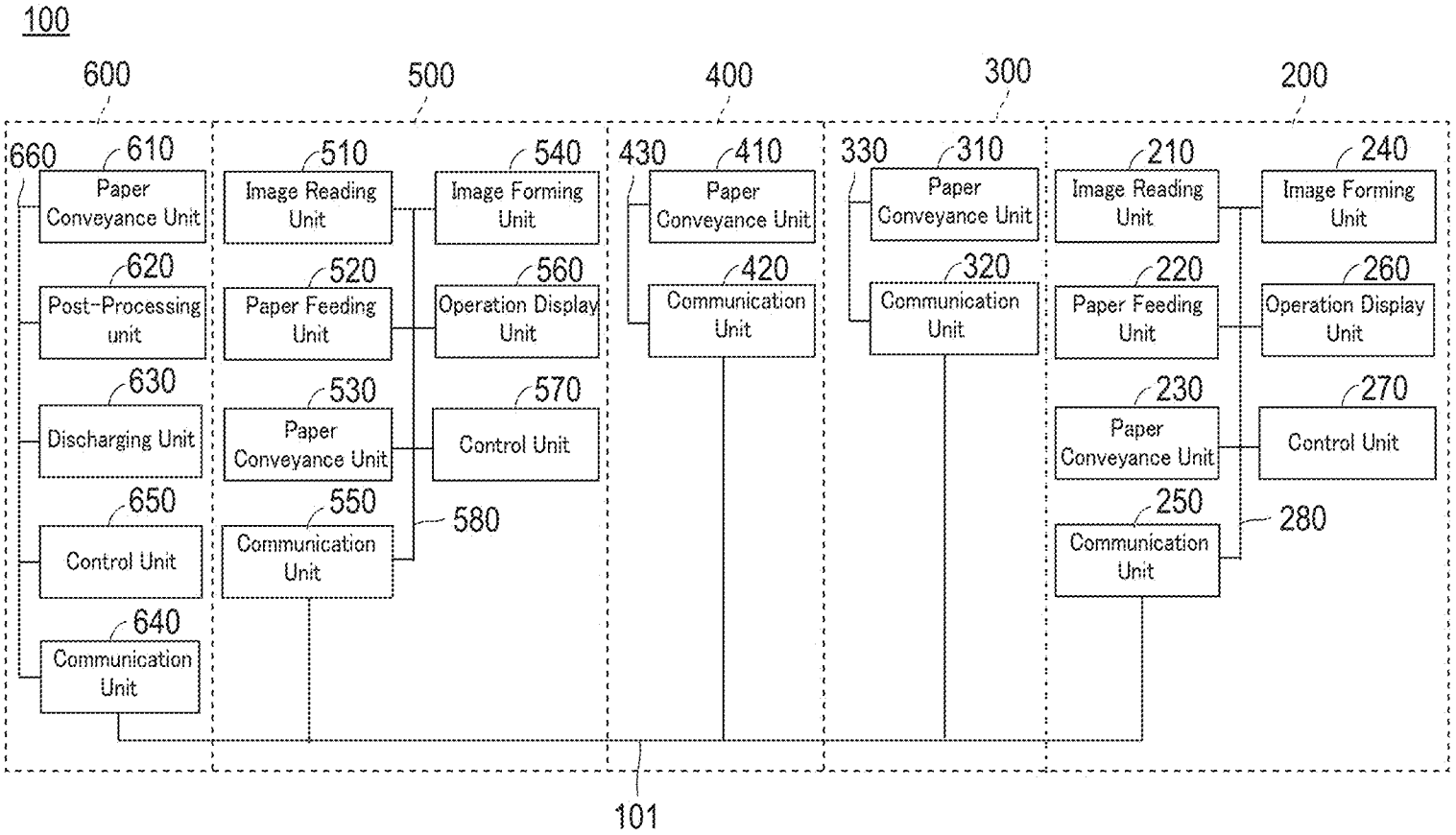
FIG. 2 is a schematic block diagram exemplifying a configuration of the image forming system illustrated in FIG. 1.
Figure 3:
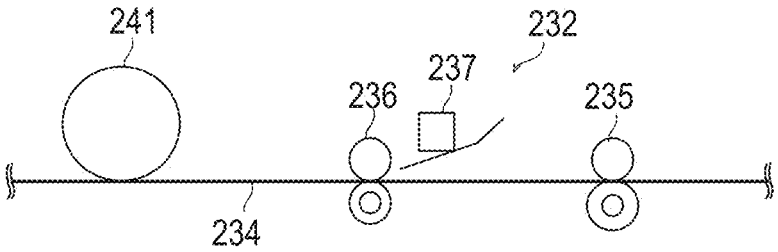
FIG. 3 is a schematic diagram exemplifying a configuration of a resist unit of the upstream apparatus illustrated in FIG. 1.
Figure 4:
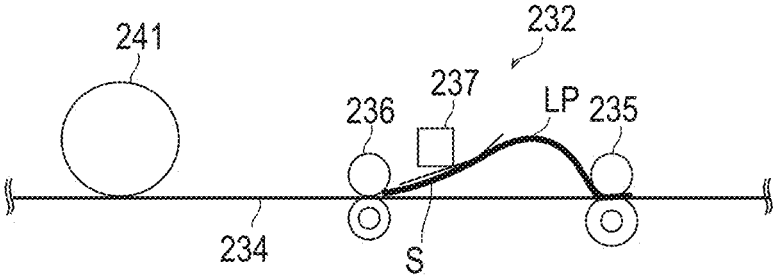
FIG. 4 is a schematic diagram exemplifying the creation of the resist loop at the resist unit illustrated in FIG. 3.

FIG. 1 is a schematic cross-sectional view exemplifying a configuration of the image forming system according to the first embodiment and FIG. 2 is a schematic block diagram exemplifying a configuration of the image forming system illustrated in FIG. 1. Further, FIG. 3 is a schematic diagram exemplifying a configuration of the resist unit of the upstream apparatus illustrated in FIG. 1 and FIG. 4 is a schematic diagram exemplifying the creation of the resist loop at the resist unit illustrated in FIG. 3.

<Image Forming System 100>

As illustrated in FIG. 1, an image forming system 100 includes an upstream apparatus 200, a first intermediate conveying device 300, a second intermediate conveying device 400, a downstream apparatus 500, and a post-processing device 600, all of which are connected in series along the paper conveyance direction. The upstream apparatus 200 and the downstream apparatus 500 operate as the image forming apparatus of the series tandem system.

In the image forming system 100, the upstream apparatus 200 prints only the surface of the paper, the first intermediate conveying device 300 reverses front and back of the paper, and then the downstream apparatus 500 prints only the back surface of the paper to enable executing the double-side print processing at a high speed. The upstream apparatus 200, the first intermediate conveying device 300, and the downstream apparatus 500 are connected in series to make the conveying path of the paper almost linear, and thus, the image forming system 100 can ensure the high reliability for the paper conveyance.

A configuration of the image forming system 100 illustrated in FIG. 1 is merely an example and a type and the number of devices included in the image forming system 100 are not limited to those in an example of FIG. 1. For example, the image forming system 100 can include the paper feeder that accommodates a large amount of papers as recording materials and supplies the papers to the upstream apparatus 200.

<Upstream Apparatus 200>

The upstream apparatus 200 includes an image reading unit 210, a paper feeding unit 220, a paper conveyance unit 230, an image forming unit 240, a communication unit 250, an operation display unit 260 and a control unit 270. These units are communicably connected with one another via an internal bus 280. The upstream apparatus 200 functions as the first device.

The image reading unit 210 includes an optical system configured from a mirror and a lens and a read sensor. The image reading unit 210 reads the manuscript placed on the reading surface or the manuscript conveyed by an Auto Document Feeder (ADF) to output an image signal.

The paper feeding unit 220 supplies the paper as the recording materials. The paper feeding unit 220 includes paper trays 220A and 220B and in each of the paper trays 220A and 220B, for example, A4 paper, B5 paper and the like are housed.

The paper conveyance unit 230, in the upstream apparatus 200, conveys the paper. The paper conveyance unit 230 includes a paper conveying path, a plurality of pairs of conveying rollers provided on the paper conveying path, and a resist unit 232. The detection sensors for detecting the paper that passes the paper conveying path are arranged at a plurality of positions such as exit and entrance and the branch point of the paper conveying path. The detection results of the detection sensors are transmitted to the control unit 270.

The paper conveying path includes a plurality of paths such as a path extending from the inlet 231, via the image forming unit 240, to the discharge port 233, the path extending from the paper feeding unit 220, via the image forming unit 240, to the discharge port 233, and the path extending from the image forming unit 240, via a reversing unit, to the discharge port 233. The inlet 231 is a part to which the papers are introduced from an external device such as paper feeder. A plurality of pairs of conveying rollers are driven by an unillustrated motor to convey the paper.

As illustrated in FIG. 3, the resist unit 232 includes a pair of loop rollers 235 and a pair of resist rollers 236 that are rotatably provided on a paper conveying path 234 and a conveyance sensor 237. The pair of loop rollers 235 and the pair of resist rollers 236 are respectively rotated and driven by the unillustrated motor.

The paper which is conveyed on the paper conveying path 234 and sent by the pair of loop rollers 235 has a tip inserted to the pair of resist rollers 236 whose rotation is stopped. The conveyance sensor 237 is provided between the pair of loop rollers 235 and the pair of resist rollers 236, but to a position closer to the pair of resist rollers 236 to detect the passage of the paper. The control unit 270, based on a time at which the paper passes the conveyance sensor 237, calculates a time at which the paper arrives at the pair of resist rollers 236.

As illustrated in FIG. 4, with the tip of the paper S being inserted to the pair of resist rollers 236, a rear end of the paper S is sent by the rotating pair of loop rollers 235. As a result, between the pair of resist rollers 236 and the pair of loop rollers 235, a resist loop LP is formed by the paper S.

With the resist loop LP being formed, the pair of loop rollers 235 is once stopped and the formed resist loop LP is kept. Thereafter, the pair of loop rollers 235 and the pair of resist rollers 236 start rotations at a timing to synchronize with the image formation by the image forming unit 240. Further, the resist unit 232 uses the repelling force of the paper S formed with the resist loop LP to correct the bending (skew) of the paper S in the conveyance direction. The paper S passes the pair of resist rollers 236 and is conveyed to a photosensitive drum 241 of the image forming unit 240.

Hereinafter, in the present description, the operation from when the paper S arrives at the pair of resist rollers 236 to when the resist loop LP is formed to the paper S is referred to as the "loop formation operation," and a time taken for the loop formation operation is referred to as the "loop formation time." The operation for keeping the resist loop LP is referred to as the "loop keeping operation," and a time taken for the loop keeping operation is referred to as the "loop keeping time." Further, the operation from the formation to keeping of the resist loop LP is referred to as the "resist operation," and a time taken for the resist operation is referred to as the "resist time."

The image forming unit 240 is, for example, an electrographic image forming unit and includes the photosensitive drum 241, the charging unit, the exposure unit, the developing unit, the transfer unit, the cleaning unit, the fixing unit and the like. An electrostatic latent image formed to the photosensitive drum 241 is developed by the developing unit to become a toner image.

The paper S is supplied from an exterior paper feeder or the paper feeding unit 220 and is conveyed on the paper conveying path 234, at the pair of resist rollers 236, a timing at which the paper S is conveyed to the photosensitive drum 241 is controlled, and the paper S is conveyed to the transfer unit that synchronizes with the toner image. The paper S to which the toner image is transferred by the transfer unit is conveyed to the fixing unit at a downstream side in the paper conveyance direction, and on the paper S, the toner image is fixed.

The communication unit 250 is, via a network, connected with a client terminal of a user to transmit and receive print jobs and various pieces of data. Further, the communication unit 250 is, via a communication line 101, communicably connected with other devices in the image forming system 100 to transmit and receive various pieces of information and data including printing setting information and information on defects such as paper jam.

The operation display unit 260 includes, for example, the display and the keyboard, or the touch panel and functions as an input unit and an output unit. The keyboard includes a plurality of keys such as a selection key for specifying a size of a paper, a numeric keypad for setting the number of copies and the like, a start key for instructing the start of operations, and a stop key for instructing the stop of operations. The input unit is used by the user for performing various instructions such as character entry, various settings, and the start instruction. The output unit is used to present, to the user, the equipment configuration, the implementation status of the print job, the occurrence of the paper jam, the occurrence of errors, currently changeable setting and the like.

The control unit 270 controls the image reading unit 210, the paper feeding unit 220, the paper conveyance unit 230, the image forming unit 240, the communication unit 250, the operation display unit 260, and the first intermediate conveying device 300.

The control unit 270 includes the unillustrated auxiliary memory device, memory and Central Processing Unit (CPU). The auxiliary memory device, the memory, and the CPU are communicably connected with one another via the internal bus.

The auxiliary memory device includes, for example, a large-capacity storage device such as a hard disk drive and a flash memory. The memory includes a Random Access Memory (RAM) and a Read Only Memory (ROM). The RAM stores an operation result obtained by the execution of the CPU.

In the control unit 270, the CPU executes the control program for the upstream apparatus. The control program for the upstream apparatus is, for example, stored in the auxiliary memory device, and when executed by the CPU, is loaded to the RAM of the memory. The CPU, in accordance with the above described control program, controls the image reading unit 210, the paper feeding unit 220, the paper conveyance unit 230, the image forming unit 240, the communication unit 250, the operation display unit 260 and the first intermediate conveying device 300 to realize various functions.

The control unit 270 receives, from the client terminal of the user, print jobs and based on printing setting information included in the print jobs, sets various printing conditions. For example, the control unit 270, based on the printing setting information, sets the "reference printing cycle" which specifies the timing to start printing. The printing setting information includes, for example, the paper size, the paper direction, the paper type, the basis weight, the print gap and the like. In the present embodiment, the printing setting information may include "the number of print copies of resynchronization." The number of print copies of resynchronization will be described later. The printing setting information is transmitted, via the communication unit 250, to the downstream apparatus 500.

The control unit 270, based on, for example, the print gap of the printing setting information, sets the reference printing cycle. The upstream apparatus 200, in accordance with the set reference printing cycle, executes the printing process. In the present description, relative to the reference printing cycle which is derived based on the printing setting information, the measured value of the time interval of a plurality of papers that are continuously conveyed from the pair of resist rollers 236 to the photosensitive drum 241 is referred to as the "upstream side printing cycle."

<First Intermediate Conveying Device 300>

The first intermediate conveying device 300 is located between the upstream apparatus 200 and the second intermediate conveying device 400 and includes a paper conveyance unit 310 and a communication unit 320. The paper conveyance unit 310 and the communication unit 320 are communicably connected via an internal bus 330.

The paper conveyance unit 310 introduces the paper supplied from the upstream apparatus 200, and in accordance with the instruction of the control unit 270, reverses front and back of the paper to supply the paper to the second intermediate conveying device 400, or without reversing front and back of the paper, supplies the paper to the second intermediate conveying device 400. The paper conveyance unit 310 may convey the paper at the conveyance speed which is the same as the conveyance speed when the upstream apparatus 200 supplies the paper to the first intermediate conveying device 300.

The communication unit 320, via the communication line 101, transmits/receives various pieces of data to/from the upstream apparatus 200.

<Second Intermediate Conveying Device 400>

The second intermediate conveying device 400 is located between the first intermediate conveying device 300 and the downstream apparatus 500 and includes the paper conveyance unit 410 and the communication unit 420.

The paper conveyance unit 410 conveys the paper supplied from the first intermediate conveying device 300 to the downstream apparatus 500. The paper conveyance unit 410 receives the paper from the first intermediate conveying device 300 at the conveyance speed which is the same as the conveyance speed when the paper conveyance unit 310 supplies the paper to the paper conveyance unit 410, and then lowers the conveyance speed to a conveyance speed corresponding to the printing process of the downstream apparatus 500 to convey the paper to the downstream apparatus 500.

The communication unit 420, via the communication line 101, transmits/receives various pieces of data to/from the downstream apparatus 500.

<Downstream Apparatus 500>

The downstream apparatus 500 includes an image reading unit 510, a paper feeding unit 520, a paper conveyance unit 530, an image forming unit 540, a communication unit 550, an operation display unit 560 and a control unit 570. These units are communicably connected with one another via an internal bus 580. The downstream apparatus 500 is located between the second intermediate conveying device 400 and the post-processing device 600. An upstream apparatus 500 functions as the second device.

Configurations of the image reading unit 510, the paper feeding unit 520, the paper conveyance unit 530, the image forming unit 540, the communication unit 550, the operation display unit 560 and the control unit 570 are respectively the same as configurations of the image reading unit 210, the paper feeding unit 220, the paper conveyance unit 230, the image forming unit 240, the communication unit 250, the operation display unit 260 and the control unit 270, and thus, detailed descriptions of the configurations are omitted. Hereinafter, among the configurations of the downstream apparatus 500, configurations which are different from the configurations of the upstream apparatus 200 are mainly described.

The paper conveyance unit 530 includes the paper conveying path, a plurality of pairs of conveying rollers provided on the paper conveying path, and a resist unit 532, and conveys the paper, along the paper conveying path, from a paper introduction unit 531 to the image forming unit 540. The paper introduction unit 531 introduces a plurality of papers including the paper which is discharged from the upstream apparatus 200 and a following paper that follows the paper.

A conveyance sensor 537 (see FIG. 6) functions as the paper detection unit, is provided to the predetermined position of the paper conveying path that extends from the paper introduction unit 531 to the image forming unit 540, and detects the paper that passes the predetermined position. The image forming unit 540 functions as the paper processing unit and performs the printing process on the paper.

The communication unit 550 functions as the printing setting acquisition unit and receives, from the upstream apparatus 200, the printing setting information on each paper. In the present embodiment, via the communication unit 550, it is not possible to transmit the information on the paper conveyance such as a paper location at the upstream apparatus 200 and conveyance speed to the downstream apparatus 500.

Further, the image forming system 100 does not have other ways of transmitting the information on the paper conveyance from the upstream apparatus 200 to the downstream apparatus 500 between the upstream apparatus 200 and the downstream apparatus 500. Accordingly, the downstream apparatus 500 is blocked from the information on the paper conveyance.

The control unit 570 controls the image reading unit 510, the paper feeding unit 520, the paper conveyance unit 530, the image forming unit 540, the communication unit 550, the operation display unit 560 and the second intermediate conveying device 400. The control unit 570 includes the unillustrated auxiliary memory device, memory, and CPU.

In the control unit 570, the CPU executes the control program for the downstream apparatus. The control program for the downstream apparatus is, for example, stored in the auxiliary memory device, and when executed by the CPU, is loaded to the RAM of the memory. The CPU, in accordance with the above described control program, controls the image reading unit 510, the paper feeding unit 520, the paper conveyance unit 530, the image forming unit 540, the communication unit 550, the operation display unit 560 and the second intermediate conveying device 400 to realize various functions.

The control unit 570 receives, from the upstream apparatus 200, the printing setting information and based on the printing setting information, sets various printing conditions. In the present embodiment, the control unit 570, based on the printing setting information, sets the "printing cycle" that specifies the timing to start printing. More specifically, the control unit 570 functions as the print cycle calculating unit and based on the printing setting information of the paper and a time at which the paper passes the predetermined position, sets the printing cycle.

The control unit 570 functions as the delay time calculating unit and based on the set printing cycle and a time at which the following paper passes the predetermined position, calculates the delay time from the printing cycle of the following paper.

Further, the control unit 570 functions as the conveyance control unit, stops the conveyance of the following paper that is conveyed toward the image forming unit 540, and in accordance with the delay time, controls resuming of the stopped conveyance of the following paper.

In the present description, relative to the printing cycle derived based on the printing setting information, the measured value of the time interval of a plurality of papers continuously conveyed from the pair of resist rollers 536 (see FIG. 6) of the resist unit 532 to the photosensitive drum 541 is referred to as the "downstream side printing cycle."

<Post-Processing Device 600>

The post-processing device 600 conveys or performs post-processing on the paper supplied from the downstream apparatus 500 and discharges the paper to the exterior of the image forming system 100. The post-processing device 600 includes a paper conveyance unit 610, a post-processing unit 620, a paper discharging unit 630, a communication unit 640 and a control unit 650. In the image forming system 100, the post-processing device 600 is arranged at the most downstream position in the paper conveyance direction.

The paper conveyance unit 610 conveys the paper that is introduced from the paper introduction unit 611 to the post-processing unit 620 and conveys, to the paper discharge unit 612, the paper on which the post-processing is performed. The paper conveyance unit 610 conveys, the paper which is introduced form the paper introduction unit 611, along the paper conveying path, to the paper discharge unit 612.

The post-processing unit 620 performs the post-processing on the paper. In the present embodiment, the post-processing includes, for example, the punch processing, the stapling, the curl correction processing, the reverse processing and the like.

The communication unit 640 is, via the communication line 101, communicably connected with other devices in the image forming system 100 to transmit and receive various pieces of data.

The control unit 650 includes the unillustrated auxiliary memory device, memory and CPU. Respective components are communicably connected with one another via the bus.

The auxiliary memory device includes, for example, the large-capacity storage device such as hard disk drive and flash memory and stores the control program for the post-processing device. The memory includes the RAM and the ROM. In the control unit 650, the CPU executes the above described control program and controls the paper conveyance unit 610, the post-processing unit 620, the paper discharging unit 630, and the communication unit 640 to realize various functions.

<Control Method of Image Forming System 100>

Figure 5:
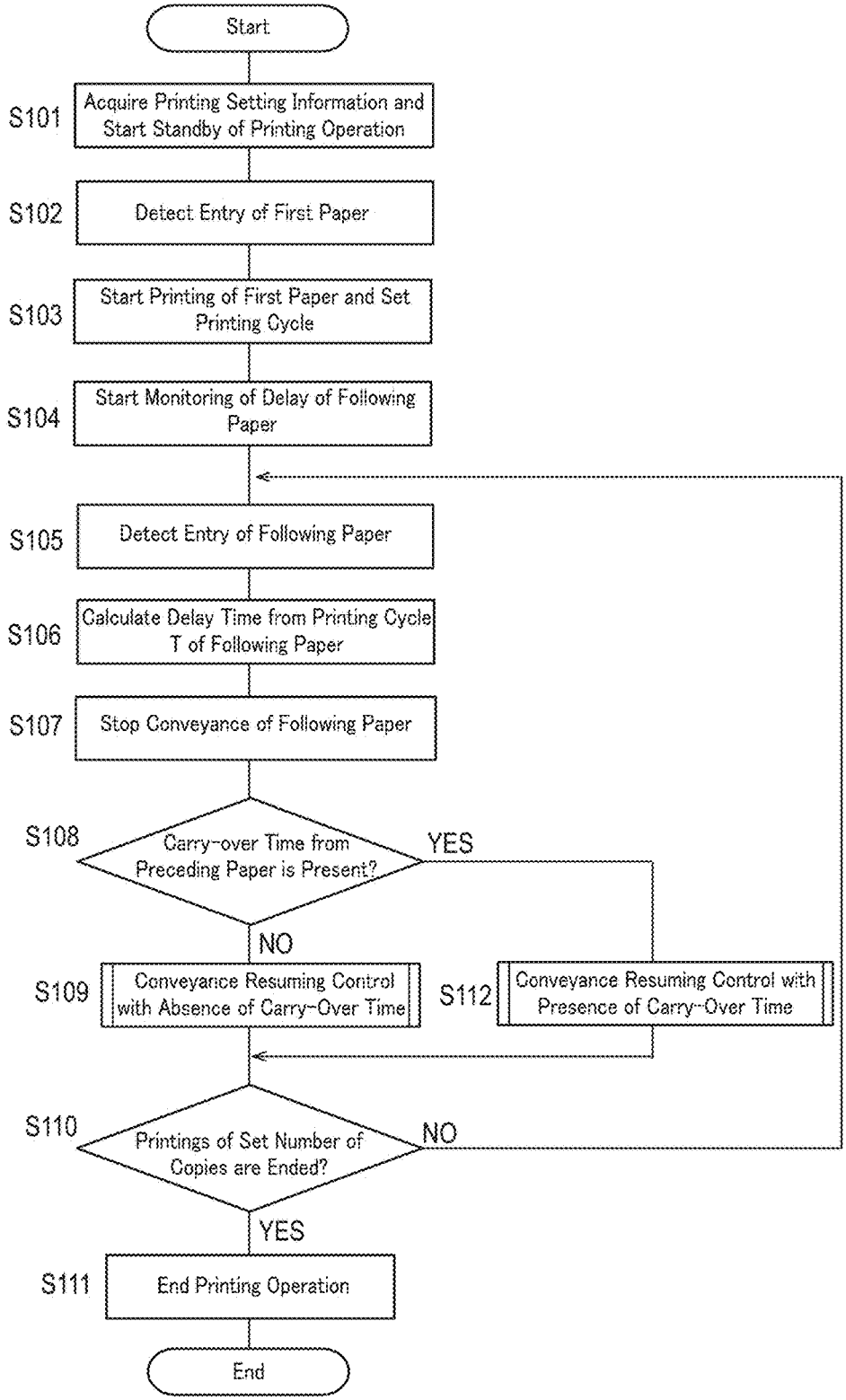
FIG. 5 is a flowchart exemplifying a control method of the downstream apparatus according to the first embodiment.
Figure 6:
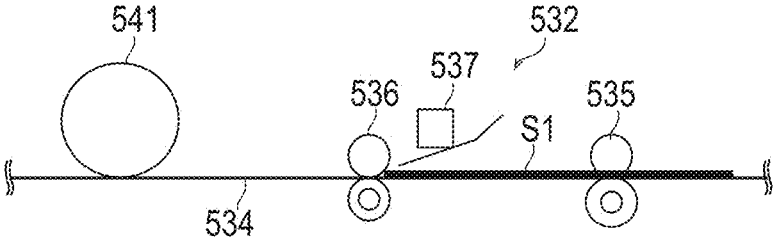
FIG. 6 is a schematic diagram exemplifying operations of the resist unit of the downstream apparatus illustrated in FIG. 1.
Figure 7:
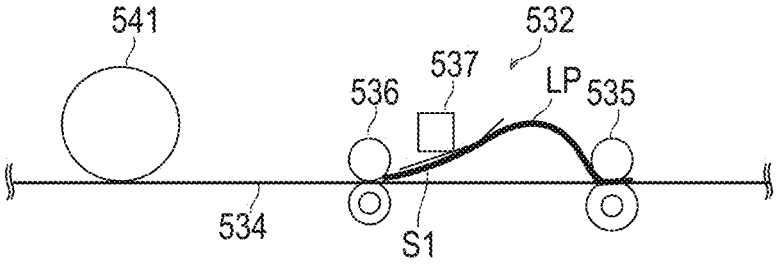
FIG. 7 is a schematic diagram exemplifying operations of the resist unit of the downstream apparatus illustrated in FIG. 1.
Figure 8:
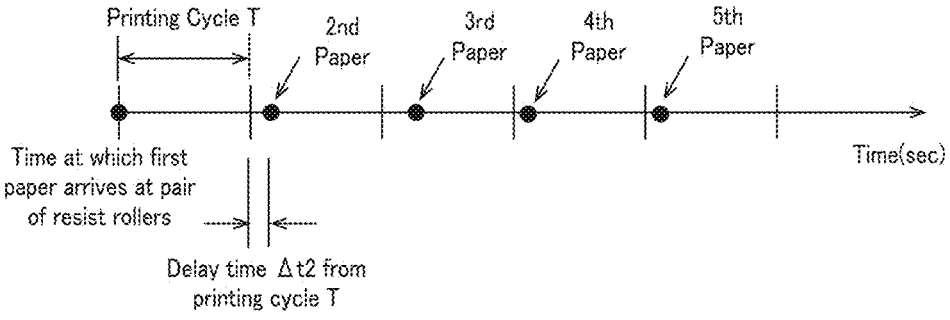
FIG. 8 is a schematic diagram exemplifying a delay of the paper arriving at a pair of resist rollers of the downstream apparatus illustrated in FIG. 1.

Hereinafter, with reference to FIG. 5 to FIG. 8, the control method of the image forming system 100 according to the first embodiment is described. FIG. 5 is a flowchart exemplifying the control method of the downstream apparatus 500 according to the first embodiment. Processes in the flowchart illustrated in FIG. 5 are realized by the CPU of the control unit 570 executing the control program for the downstream apparatus. Further, FIG. 6 and FIG. 7 are schematic diagrams exemplifying operations of the resist unit 532 of the downstream apparatus 500 illustrated in FIG. 1. FIG. 8 is a schematic diagram exemplifying the delay of the paper that arrives at the pair of resist rollers 536 of the downstream apparatus 500 illustrated in FIG. 1.

The control unit 270 of the upstream apparatus 200 receives, from the client terminal of the user, print jobs and based on the printing setting information included in the print jobs, sets various printing conditions. The control unit 270, based on, for example, the print gap of the printing setting information, sets the reference printing cycle. The control unit 270, from the exterior paper feeder or the paper feeding unit 220, continuously supplies the paper to the paper conveyance unit 230, in accordance with the set reference printing cycle, sequentially forms an image on the paper at the image forming unit 240, and discharges the paper to the first intermediate conveying device 300.

The paper discharged from the upstream apparatus 200 passes the first intermediate conveying device 300 and the second intermediate conveying device 400 and is conveyed to the downstream apparatus 500. For example, at the first intermediate conveying device 300, front and back of the paper are reversed. The first intermediate conveying device 300 and the second intermediate conveying device 400 respectively convey the papers at the specified conveyance speed.

As illustrated in FIG. 5, the downstream apparatus 500 acquires the printing setting information and starts the standby of the printing operation (step S101). The control unit 570 receives, from the upstream apparatus 200, the printing setting information and makes preparations to perform printing (image formation) for each unit in the downstream apparatus 500 and wait.

Next, the entry of a first paper is detected (step S102). The control unit 570, based on the detection result of the detection sensor of the paper conveying path, detects the entry of the first paper S1 (first paper) to the downstream apparatus 500.

As illustrated in FIG. 6, the paper S1 is conveyed to the pair of resist rollers 536 of the resist unit 532 by the paper conveyance unit 530 and has a tip inserted to the pair of resist rollers 536. The control unit 570, based on a time at which the paper S1 passes the predetermined position of the paper conveying path, calculates a time tr at which the paper S1 arrives at the pair of resist rollers 536 and stores the calculated time in a storage unit.

As illustrated in FIG. 7, with a tip of the paper S1 being inserted to the pair of resist rollers 536, by a rotating pair of loop rollers 535, the rear end of the paper S1 is sent. As a result, between the pair of resist rollers 536 and the pair of loop rollers 535, the resist loop LP is formed to the paper S1.

With the resist loop LP being formed, the pair of loop rollers 535 is once stopped, and the formed resist loop LP is kept. Thereafter, the pair of loop rollers 535 and the pair of resist rollers 536 start rotations at a timing to synchronize with the image formation by the image forming unit 540. Further, the resist unit 532 uses the repelling force of the paper S1 formed with the resist loop LP to correct bending (skew) relative to the conveyance direction of the paper S1. The paper S1 passes the pair of resist rollers 536 and is conveyed to a photosensitive drum 541 of the image forming unit 540.

Next, printing of the first paper S1 is started and the printing cycle is set (step S103). The image forming unit 540 starts the image formation on the paper S1. The control unit 570 analyzes the received printing setting information and sets the printing cycle T that specifies the timing to start the image formation. More specifically, the control unit 570, based on the time tr at which the paper S1 arrives at the pair of resist rollers 536 and the print gap included in the printing setting information, sets the above described printing cycle T.

Next, monitoring of the delay of the following paper is started (step S104). In the present description, any one of the second and following papers is referred to as the following paper (second paper). Further, for example, the following paper is described as S2, S3, S4, . . . , Sn. In the image forming system 100, in the context of keeping the productivity of the printing process, it is desirable that the upstream side printing cycle and the downstream side printing cycle always synchronize.

In the image forming system 100, the upstream apparatus 200, in accordance with the reference printing cycle, performs the printing process at regular intervals and discharges the paper. The first intermediate conveying device 300 and the second intermediate conveying device 400 respectively convey the papers at the specified conveyance speed, and thus, all papers that are conveyed from the upstream apparatus 200 to the downstream apparatus 500 are conveyed to the downstream apparatus 500 at the same length of conveyance time. Accordingly, ideally, the variation is not caused to the arriving time of the paper conveyed to the downstream apparatus 500.

However, realistically, in the paper passing state between the upstream apparatus 200 and the downstream apparatus 500, due to the friction between the paper and the paper conveying path and the difference in the slipping of the paper relative to the rotation of the conveying roller, the delay is caused to the paper conveyance. The control unit 570 monitors the delay in each of the following papers Sn that passes the conveyance sensor 537.

Next, the entry of the following paper Sn is detected (step S105). The control unit 570, based on the detection result of the detection sensor of the paper conveying path, detects the entry of the following paper Sn to the downstream apparatus 500. The following paper Sn is conveyed by the paper conveyance unit 530 to the pair of resist rollers 536 and has a tip inserted to the pair of resist rollers 536. The control unit 570, based on a time at which the following paper Sn passes the predetermined position of the paper conveying path, calculates a time at which the following paper Sn arrives at the pair of resist rollers 536 and stores the calculated time to the storage unit.

Next, the delay time is calculated from the printing cycle T of the following paper Sn (step S106). The control unit 570, based on a time at which the following paper Sn arrives at the pair of resist rollers 536 with reference to a time tr at which the paper S1 arrives at the pair of resist rollers 536, measures the delay from the printing cycle T of the following paper Sn.

For example, as illustrated in FIG. 8, a time at which the second paper S2 arrives at the pair of resist rollers 536 is delayed by Δt2 from the printing cycle T. Similarly, the third paper S3, the fourth paper S4, and the fifth paper S5 also arrive with delays from the printing cycle T.

Next, the conveyance of the following paper Sn is stopped (step S107). The control unit 570 stops the conveyance of the following paper Sn that has arrived at the pair of resist rollers 536. In the present embodiment, as described later, by controlling resuming of the conveyance of the following paper Sn whose conveyance is stopped at the resist unit 532, the delay time of the following paper Sn is solved or reduced. In the present description, an operation of solving or reducing the delay time of the following paper Sn is referred to as the "recovery operation."

Next, whether the carry-over time from the preceding paper is present is determined (step S108). The carry-over time corresponds to the delay time which is not solved at the preceding paper that precedes the following paper Sn, and the carry-over time is carried over to the following paper Sn.

When the carry-over time from the preceding paper is absent (step S108: NO), the control unit 570 executes the conveyance resuming control with the absence of the carry-over time (step S109). On the other hand, when the carry-over time from the preceding paper is present (step S108: YES), the control unit 570 executes the conveyance resuming control with the presence of the carry-over time (step S112). Details of the conveyance resuming control with the absence of the carry-over time and the conveyance resuming control with the presence of the carry-over time are described later.

Next, whether printings of set number of copies are ended is determined (step S110). When printings of the set number of copies are not ended, (step S110: NO), the process proceeds to step S105.

On the other hand, when printings of the set number of copies are ended (step S110: YES), the printing operation is ended (step S111). The control unit 570 executes the processes for ending the printing process and starts preparation for accepting the next print job. Then, the control unit 570 ends the control processing (End).

<Conveyance Resuming Control with Absence of Carry-over Time>

Figure 9:
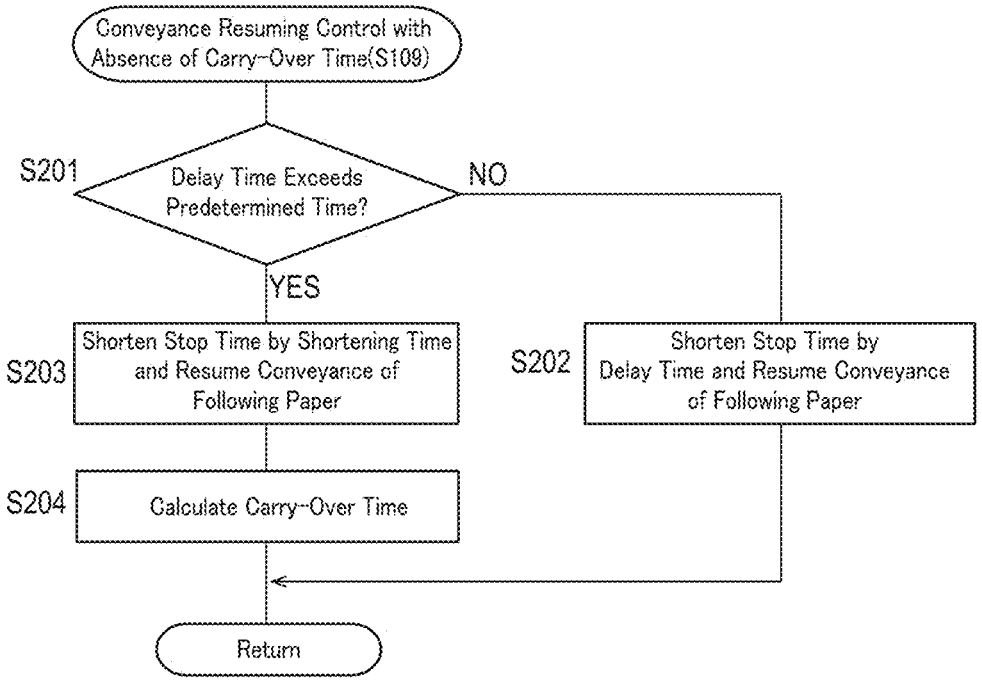
FIG. 9 is a subroutine flowchart exemplifying the process of "conveyance resuming control with absence of carry-over time" in the flowchart illustrated in FIG. 5.
Figure 10:
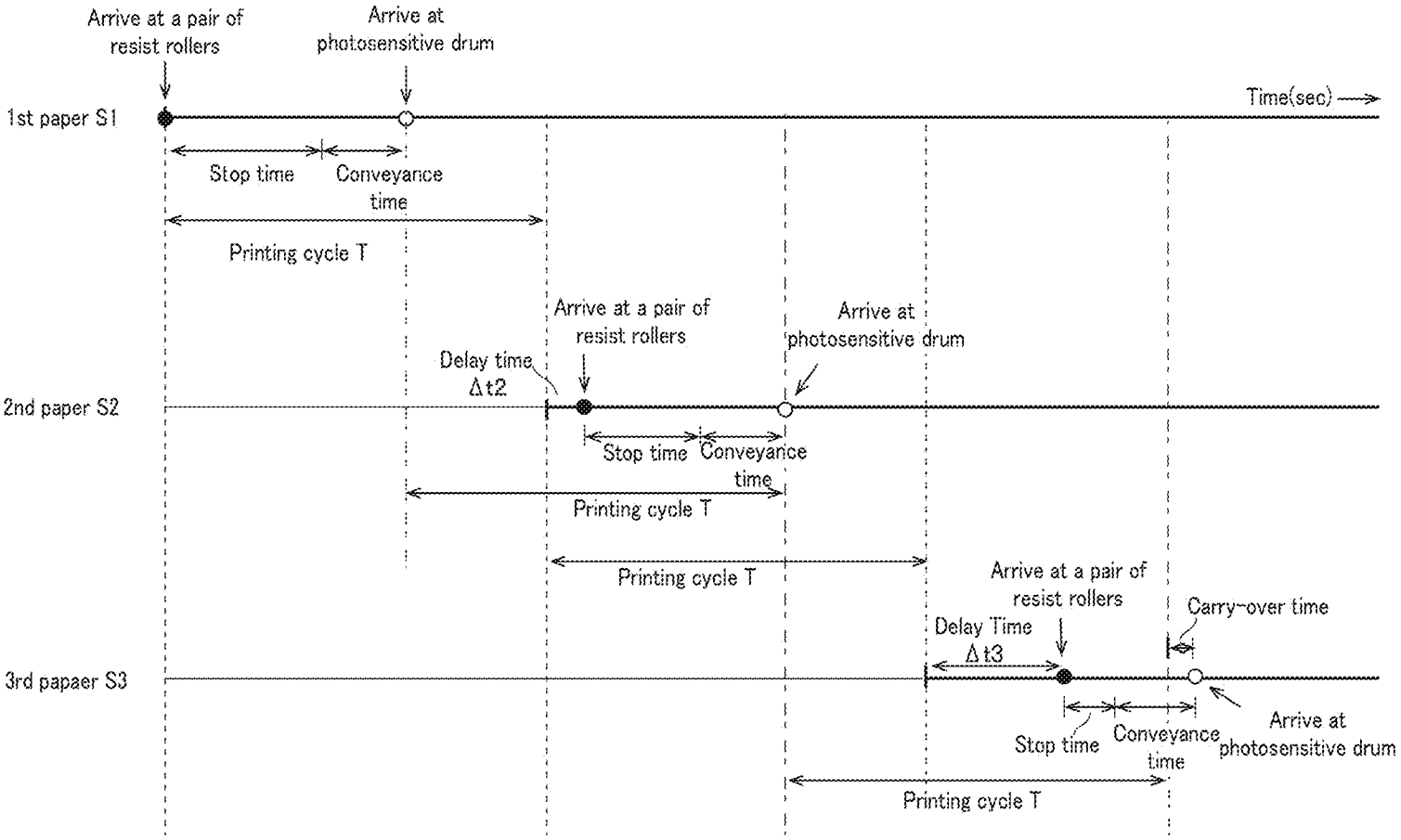
FIG. 10 is a schematic diagram illustrating an overview of the recovery operation of the first embodiment by keeping a track of the elapse of time.

FIG. 9 is a subroutine flowchart exemplifying the process (step S109) of "conveyance resuming control with absence of carry-over time" in the flowchart of FIG. 5, and FIG. 10 is a schematic diagram illustrating the overview of the recovery operation of the present embodiment by keeping a track of the elapse of time.

First, as illustrated in FIG. 9, whether the delay time of the following paper Sn exceeds the predetermined time is determined (step S201). The predetermined time is a parameter (threshold value) that specifies a margin that can absorb the delay time and can be set within the resist time. For example, as the predetermined time, it is possible to set the resist time, i.e., a total time of the loop formation time and the loop keeping time. However, if the predetermined time is set by exceeding the loop keeping time, the loop formation on the following paper Sn is not completed, and it is possible that the skew correction may not be appropriately performed. Therefore, it is preferable to set the predetermined time within the loop keeping time.

A fixed value of the predetermined time may be stored in advance in the storage unit and the like of the control unit 570 or may be appropriately changed through user inputs.

When the delay time does not exceed the predetermined time (step S201: NO), the stop time is shortened by the delay time, and the conveyance of the following paper Sn is resumed (step S202). For example, as illustrated in FIG. 10, when the delay time Δt2 of the second paper S2 does not exceed the predetermined time, the stop time is shortened by the delay time Δt2 and the conveyance of the paper S2 is resumed. As a result, the paper S2, without delaying from the printing cycle T, arrives at the photosensitive drum 541. Returning to FIG. 9, the process of the control unit 570 proceeds to step S110 (Return).

On the other hand, when the delay time exceeds the predetermined time (step S201: YES), the stop time is shortened by the shortening time and the conveyance of the following paper Sn is resumed (step S203). For example, as illustrated in FIG. 10, when the delay time Δt3 of the third paper S3 exceeds the predetermined time, the control unit 570 shortens the stop time by the shortening time and resumes the conveyance of the following paper Sn. The control unit 570 determines that the delay time Δt3 may not be absorbed only with the stop time of the paper S3, and determines to carry over the delay time (carry-over time) which is not absorbed to a next following paper (fourth paper S4) of the paper S3.

Next, the carry-over time is calculated (step S204). The control unit 570 subtracts, from the delay time, the shortening time and calculates the carry-over time. In the context of not increasing the loads of the recovery operation to the paper S4 and following papers, it is desirable to set the shortening time such that that the carry-over time becomes short. To shorten the carry-over time, the shortening time needs to be long. However, if the shortening time is long, the stop time becomes short. The shortening time may be appropriately set considering the mechanical constraints of the stop time in the resist unit 532.

Further, if the shortening time is set by exceeding the loop keeping time, the loop formation on the following paper Sn is not completed, and it is possible that the skew correction is not appropriately performed. Therefore, it is preferable to set the shortening time within the loop keeping time.

Further, the shortening time may be set to a uniform value relative to any following paper Sn or may be set to a different value relative to the specific following paper Sn.

Figure 11:
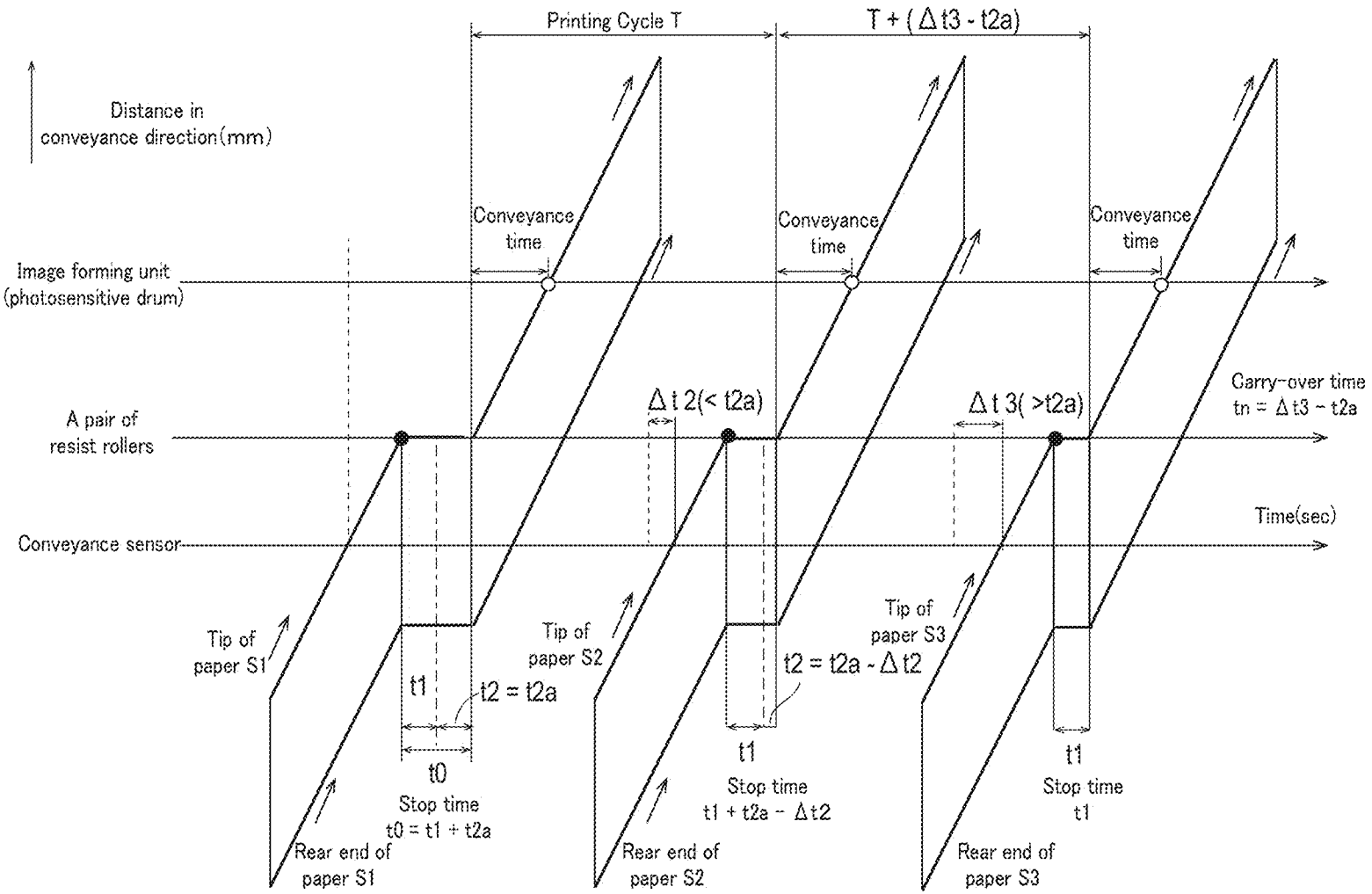
FIG. 11 is a schematic diagram illustrating conveyance operations of the paper when the loop keeping time is set to the predetermined time by keeping a track of the elapse of time.

Hereinafter, with reference to FIG. 11, details of the conveyance operation of the paper in the downstream apparatus 500 are described. FIG. 11 is a schematic diagram illustrating the conveyance operation of the paper when as the predetermined time, the loop keeping time is set by keeping a track of the elapse of time. A horizontal axis represents a time and a vertical axis represents a distance in the conveyance direction in the downstream apparatus 500. FIG. 11 illustrates locus of positions of tips and rear ends of the papers S1 to S3 by keeping a track of the elapse of time. A reference value of the loop keeping time is set to t2*a*.

The first paper S1 passes the conveyance sensor 537 and arrives at the pair of resist rollers 536 (a position illustrated with "●"). The control unit 570, during a stop time t0, i.e., a sum of a loop formation time (t1) and a loop keeping time (t2=t2*a*), stops the conveyance of the paper S1. Thereafter, the control unit 570 resumes the conveyance of the paper S1 and conveys the paper S1 toward the photosensitive drum 541. The paper S1, after elapse of the "conveyance time," arrives at the photosensitive drum 541 (position illustrated with "○").

The second paper S2, delaying by the delay time Δt2 (<t2*a*), passes the conveyance sensor 537 and arrives at the pair of resist rollers 536 (position illustrated with "●"). The control unit 570 forms the resist loop, then shortens the stop time by the delay time Δt2, and resumes the conveyance of the paper S2. Accordingly, the control unit 570, during the sum of the loop formation time (t1) and the loop keeping time (t2=t2*a*−Δt2), stops the conveyance of the paper S. Thereafter, the control unit 570 resumes the conveyance of the paper S2 and conveys the paper S2 to the photosensitive drum 541. The paper S2, after elapse of the "conveyance time," arrives at the photosensitive drum 541 (position illustrated with "○").

The third paper S3, delaying by the delay time Δt3(>t2*a*), passes the conveyance sensor 537 and arrives at the pair of resist rollers 536 (position illustrated with "●"). The control unit 570 forms the resist loop, and then, immediately resumes the conveyance of the paper S3. Accordingly, the loop keeping time (t2) is zero, and thus, the control unit 570, only during the loop formation time (t1), stops the conveyance of the paper S3. Thereafter, the control unit 570 resumes the conveyance of the paper S3 and conveys the paper S3 toward the photosensitive drum 541. The paper S3, after elapse of the "conveyance time," arrives at the photosensitive drum 541 (position illustrated with "○"). A carry-over time tn to the paper S4 leads to Δt3−t2*a*. The control unit 570 stores the carry-over time tn in the storage unit.

When the delay time is the predetermined time (for example, loop keeping time t2*a*) or above, the control unit 570 forms a loop on the following paper Sn, and then, upon ensuring the requisite minimum loop keeping time, can resume the stopped conveyance of the following paper Sn.

<Conveyance Resuming Control with Presence of Carry-over Time>

Figure 12:
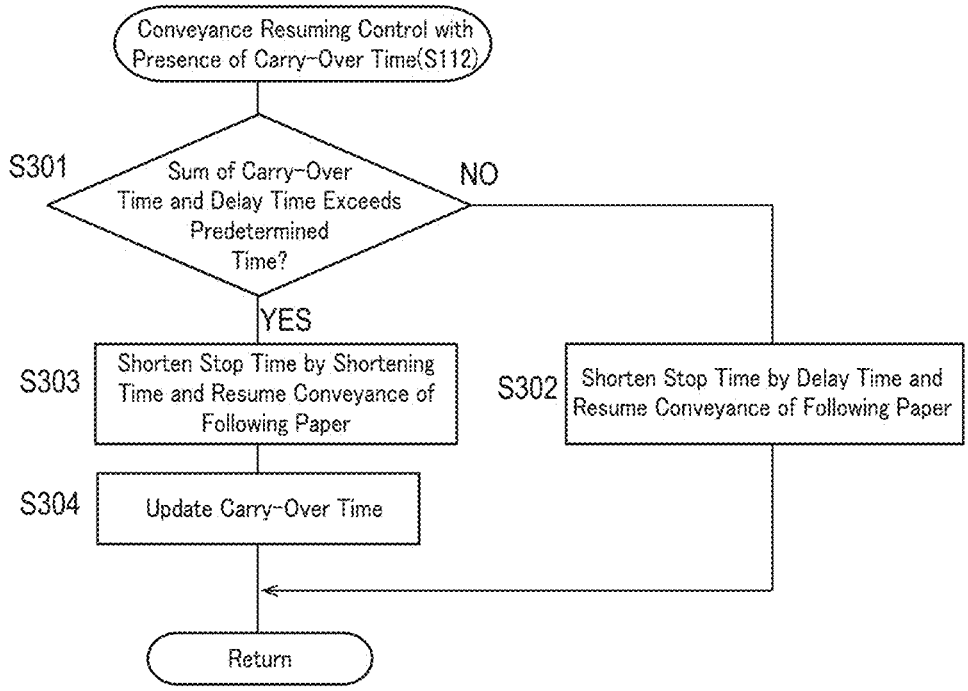
FIG. 12 is a subroutine flowchart exemplifying the process of "conveyance resuming control with presence of carry-over time" in the flowchart illustrated in FIG. 5.
Figure 13:
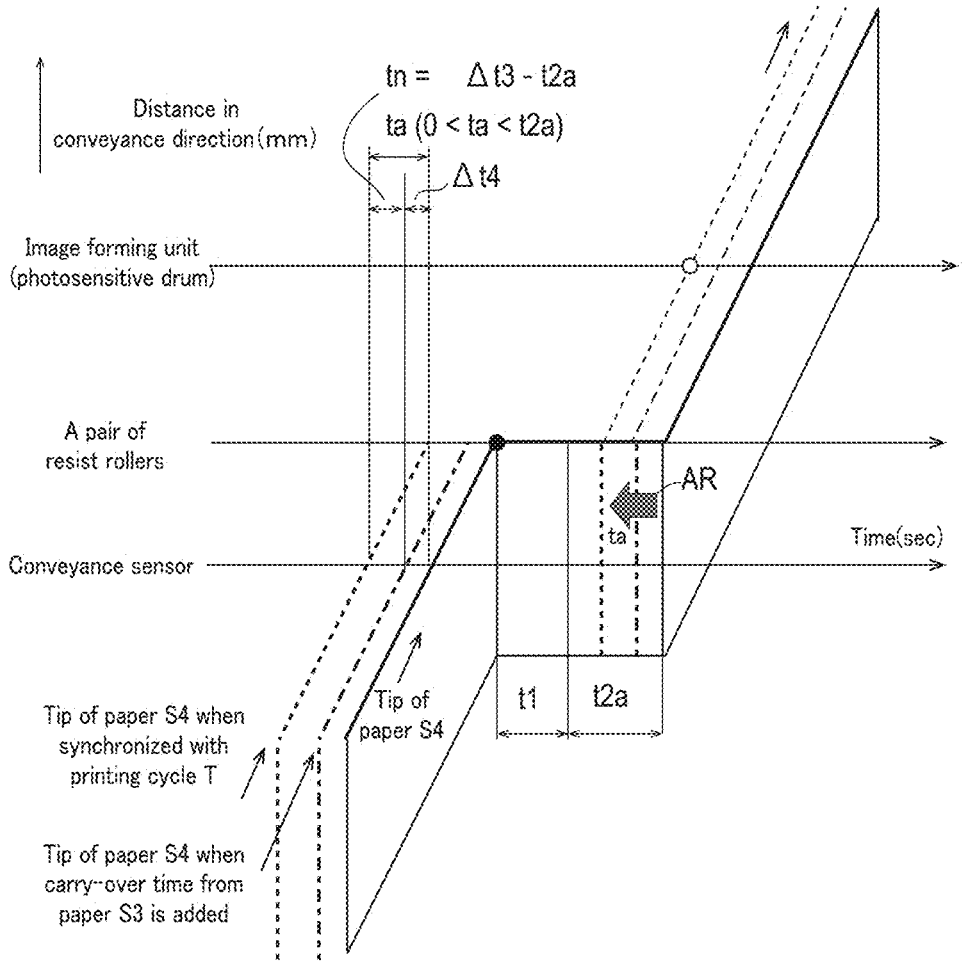
FIG. 13 is a schematic diagram illustrating recovery operations when the carry-over time is present by keeping a track of the elapse of time.

FIG. 12 is a subroutine flowchart exemplifying the process (step S112) of "conveyance resuming control with presence of carry-over time" in the flowchart of FIG. 5. Further, FIG. 13 is a schematic diagram illustrating the recovery operation when the carry-over time is present by keeping a track of the elapse of time. The horizontal axis represents a time and a vertical axis represents a distance in the conveyance direction in the downstream apparatus 500. FIG. 13 illustrates the locus of the positions of the tip and the rear end of the paper S4 by keeping a track of the elapse of time.

First, whether the sum of the carry-over time and the delay time of the following paper Sn (hereinafter, referred to as "cumulative delay time") exceeds the predetermined time is determined (step S301).

When the cumulative delay time does not exceed the predetermined time (step S301: NO), the stop time is shortened by the cumulative delay time and the conveyance of the following paper Sn is resumed (step S302). For example, when the paper S4 arrives at the pair of resist rollers 536 by involving the delay time Δt4, i.e., when the sum of the carry-over time tn of the paper S3 and the delay time Δt4 of the paper S4 does not exceed the predetermined time, the stop time is shortened by the sum (cumulative delay time) and the conveyance of the paper S4 is resumed.

As illustrated in FIG. 13, the paper S4, delaying from the printing cycle T (dash line) by a sum to of the carry-over time of the paper S3 (tn; dot-and-dash line) and the delay time Δt4 of the paper S4, passes the conveyance sensor 537 and arrives at the pair of resist rollers 536 (position illustrated with "●").

The control unit 570, in the resist unit 532, as indicated by an arrow AR, shortens the stop time by the sum to of the carry-over time to and the delay time Δt4 of the paper S4, and resumes the conveyance of the paper S4. Accordingly, the paper S4, without delaying from the printing cycle T, arrives at the photosensitive drum 541 (position illustrated with "○"). Returning to FIG. 9, the process of the control unit 570 proceeds to step S110 (Return).

On the other hand, when the cumulative delay time exceeds the predetermined time (step S301: YES), the stop time is shortened by the shortening time and the conveyance of the following paper is resumed (step S303).

Next, the carry-over time is updated (step S304). The control unit 570 subtracts, from the cumulative delay time, the shortening time and updates the carry-over time.

In this manner, in the processes of the flowchart of FIG. 5 and subroutine flowcharts of FIG. 9 and FIG. 12, when the delay time can be absorbed within the range of the resist time of the second paper, the delay time is solved with the resist time of the second paper. Accordingly, the resist time in the resist unit 532 which is the existing configuration can be utilized not only for the synchronization with the print start timing of the image forming unit 540 and the skew correction of the paper, but also to solving or reduction of the delay time of the paper.

However, when the delay time may not be absorbed within the range of the resist time of the second paper, the stop time is shortened by the first shortening time to resume the conveyance of the second paper and the delay time (first carry-over time) which is not absorbed is carried over to the third paper. The control unit 570 increments the variable k (k: initial value 3) until the cumulative delay time becomes zero or the cumulative delay time becomes small to the ignorable extent as the delay time, and following procedures [1] to [3] are repeated.

[1] The conveyance of a kth paper that is conveyed toward the image forming unit 540 is stopped.

[2] The cumulative delay time, i.e., the sum of the k−2th carry-over time and the delay time of the kth paper is calculated.

[3] When the cumulative delay time does not exceed the predetermined time, a time until the stopped conveyance of the kth paper is resumed is shortened by the cumulative delay time, and the stopped conveyance of the kth paper is resumed. On the other hand, when the cumulative delay time exceeds the predetermined time, a time until the stopped conveyance of the kth paper is resumed is shortened by the k−1th shortening time, and the stopped conveyance of the kth paper is resumed. Further, the difference between the cumulative delay time and the k−1th shortening time, i.e., the k−1th carry-over time is calculated to be stored.

Since recovery operations are performed not to a single following paper Sn but to a plurality of following papers Sn, even under the paper feeding situation which easily causes the delay time, it is possible to prevent or suppress the increase in the cumulative delay time.

Figure 14:
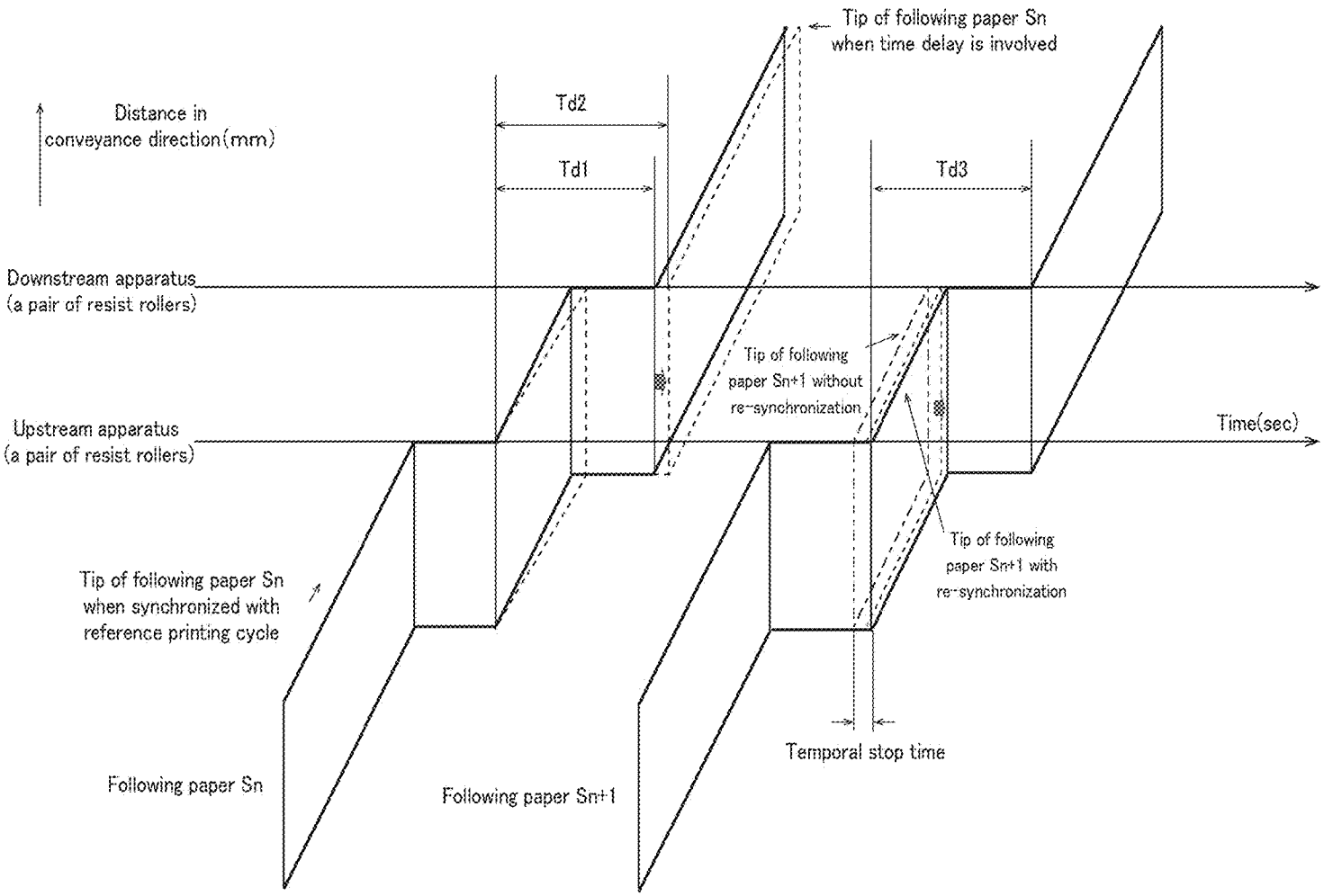
FIG. 14 is a schematic diagram exemplifying a re-synchronization process of the first embodiment.

However, depending on the paper feeding situation of the following paper Sn, it is possible that the cumulative delay time is not solved even if the recovery operations are repeated for the plurality of following papers Sn. With reference to FIG. 14, as a countermeasure for such a case, the re-synchronization process for preventing a state where the cumulative delay time is not solved from being prolonged is described.

<Re-Synchronization Process>

FIG. 14 is a schematic diagram for exemplifying the re-synchronization process of the present embodiment. The horizontal axis represents a time and the vertical axis represents the distance in the conveyance direction. FIG. 14 illustrates the locus of the positions of the tips and the rear ends of the following paper Sn and the following paper Sn+1 by keeping a track of the elapse of time.

The upstream apparatus 200, for each number of print copies of resynchronization (frequency) N (N is integer) included in the printing setting information, temporarily stops the printing process. The temporarily stopped time is a short time and preferably has the length which is the same level as the maximum value of the cumulative delay time which is not solved by the recovery operation.

The control unit 570, prior to the start of the printing process, receives, from the upstream apparatus 200, the printing setting information and acquires the number of print copies N of resynchronization included in the printing setting information. Further, the number of print copies N of resynchronization is adjustable by a user. Therefore, when the printing is actually performed, depending on the extent of the increase in the cumulative delay time, the user can adjust the frequency of the re-synchronization process.

The control unit 570, based on a first paper after temporarily stopping the printing process, resets the printing cycle T and the cumulative delay time.

As illustrated in FIG. 14, the re-synchronization process is performed on the following paper Sn+1 that reaches the number of print copies N of resynchronization. With respect to the following paper Sn, when the conveyance delay is not caused between the upstream apparatus 200 and the downstream apparatus 500 (solid line), the time difference between a time at which, from the upstream apparatus 200, the conveyance of the following paper Sn is started and a time at which, from the downstream apparatus 500, the conveyance of the following paper Sn is started is Td1. On the other hand, when the conveyance delay is caused between the upstream apparatus 200 and the downstream apparatus 500 (dash line), a time difference between a time at which, from the upstream apparatus 200, the conveyance of the following paper Sn is started and a time at which, from the downstream apparatus 500, the conveyance of the following paper Sn is started is Td2.

In the pair of resist rollers 236, the upstream apparatus 200 delays the time to start conveyance of the following paper Sn+1 by a time which is the same degree as the delay time of the following paper Sn. Accordingly, the paper Sn+1, delaying by the delayed time at the upstream apparatus 200, arrives at the pair of resist rollers 536 of the downstream apparatus 500. As a result, in the downstream apparatus 500, the following paper Sn+1 almost synchronizes with the printing cycle T.

Further, a time difference Td3 between a time at which, from the upstream apparatus 200, the conveyance of the following paper Sn+1 is started and a time at which, from the downstream apparatus 500, the conveyance of the following paper Sn+1 is started becomes almost equal to Td1, and the synchronization between the upstream apparatus 200 and the downstream apparatus 500 is also recovered.

As above, the re-synchronization process intends to solve the delay time in the downstream apparatus 500 by delaying the printing process of the upstream apparatus 200, and thus considering the influence on the productivity of the printing process, the use of the re-synchronization process is preferably kept to minimum. However, the re-synchronization process, by concurrently used with the recovery operation, can set the number of print copies N of resynchronization to a large value (for example, 1000 or above) and can suppress the frequency of the use to low. Accordingly, while suppressing the influence on the productivity of the printing process to the ignorable level, the synchronization shift between the upstream apparatus 200 and the downstream apparatus 500 can be more certainly suppressed.

The image forming system 100 of the present embodiment described above yields following effects.

The downstream apparatus 500 stops the conveyance of the following paper Sn which is conveyed to the image forming unit 540, and in accordance with the delay time of the following paper Sn, advances resuming of the stopped conveyance of the following paper Sn. Accordingly, even if the delay is caused in the paper conveyance between the upstream apparatus 200 and the downstream apparatus 500, it is possible to prevent or suppress the delay in the paper which is conveyed to the image forming unit 540 of the downstream apparatus 500. As a result, even if, between the upstream apparatus 200 and the downstream apparatus 500, the information on the paper conveyance is blocked, while maintaining the productivity of the printing process, it is possible to prevent or suppress the deviation in the synchronization of the printing cycle. Accordingly, it is possible to prevent or suppress the accumulation and enlargement of the delays in the printing cycle of the downstream apparatus 500 and the occurrence of detects in the paper feeding.

(Second Embodiment)

In the first embodiment, descriptions are given for a case in which resuming of the conveyance of the following paper whose conveyance is stopped at the resist unit is advanced and thus, the delay time of the following paper is solved or reduced. In the second embodiment, descriptions are given for a case in which, in the second intermediate conveying device, the conveyance speed of the following paper is increased to solve or reduce the delay time of the following paper. To avoid the duplication of descriptions, for configurations which are the same as those of the first embodiment, detailed descriptions are omitted.

The downstream apparatus of the present embodiment can include configurations of the downstream apparatus of the first embodiment. For example, the downstream apparatus of the present embodiment may include or not include a configuration for advancing resuming of the conveyance of the following paper Sn whose conveyance is stopped at the resist unit of the first embodiment. Further, the downstream apparatus of the present embodiment may include or not include a configuration for performing the re-synchronization process of the first embodiment.

Figure 15:
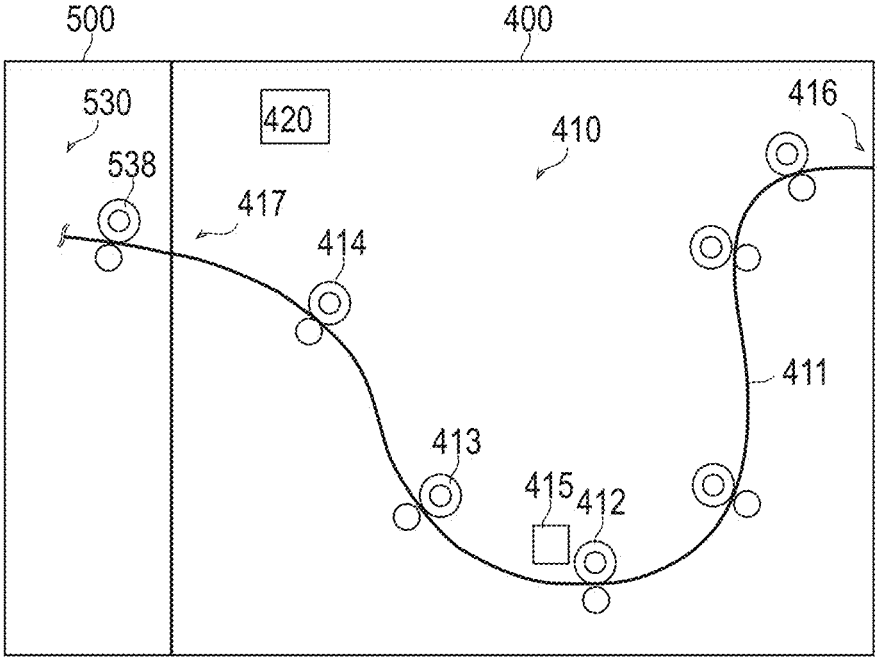
FIG. 15 is a schematic diagram exemplifying main units of a second intermediate conveying device according to a second embodiment.
Figure 16:
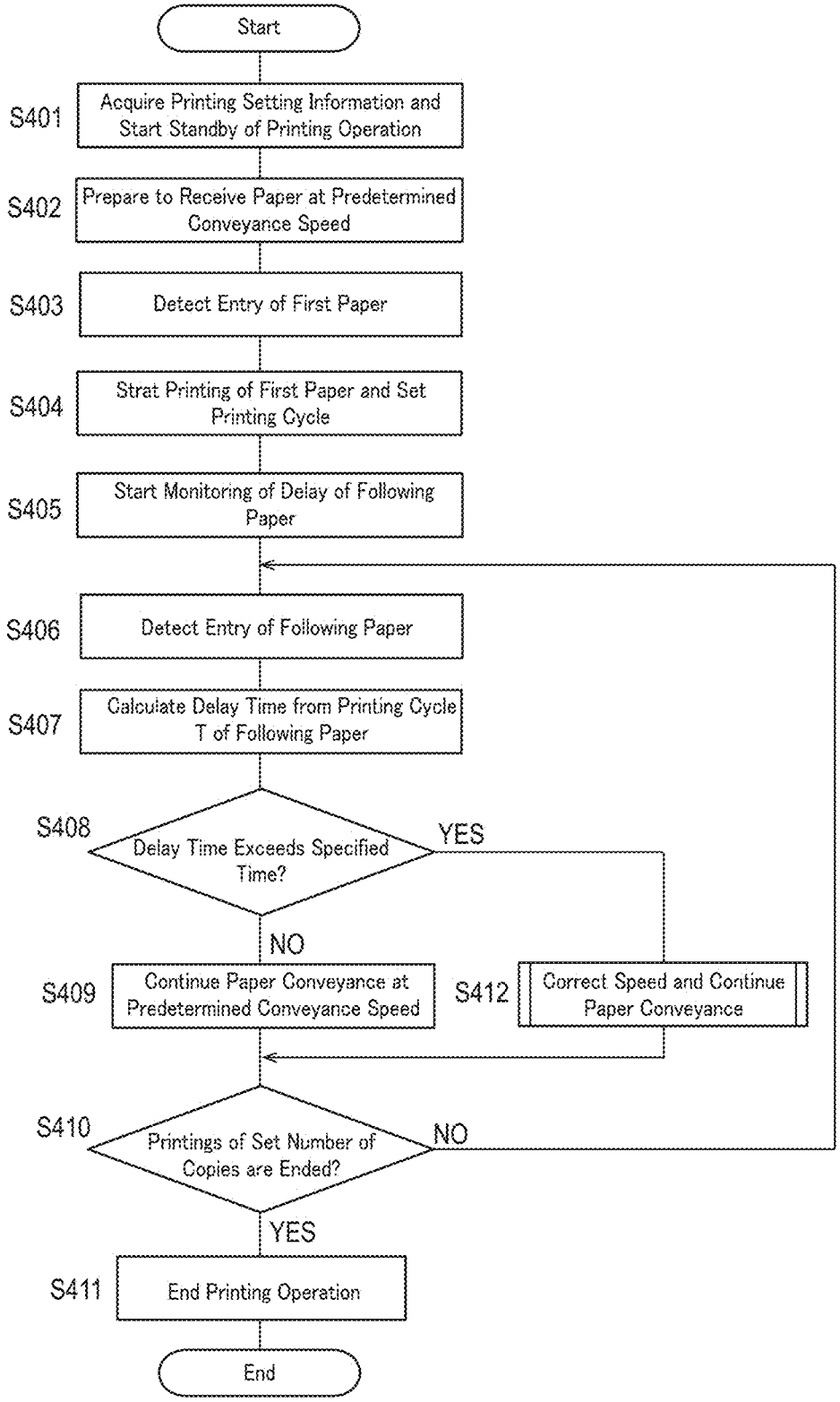
FIG. 16 is a flowchart exemplifying a control method of the downstream apparatus according to the second embodiment.

FIG. 15 is a schematic diagram exemplifying main units of the second intermediate conveying device 400 (see FIG. 1) of the present embodiment, and FIG. 16 is a flowchart exemplifying the control method of the downstream apparatus 500 (see FIG. 1) of the second embodiment. Processes in the flowchart illustrated in FIG. 16 are realized by the CPU of the control unit 570 executing the control program for the downstream apparatus.

In the present embodiment, the information on the paper conveyance is blocked between the first intermediate conveying device 300 and the second intermediate conveying device 400 and is divided between the upstream apparatus 200 and the first intermediate conveying device 300, and the second intermediate conveying device 400, the downstream apparatus 500 and the post-processing device 600. The printing setting information and information on the occurrence of defects such as paper jam are communicable among respective devices in the image forming system 100.

As illustrated in FIG. 15, the paper conveyance unit 410 includes a paper conveying path (intermediate paper conveying path) 411, a first pair of conveying rollers 412, a second pair of conveying rollers 413 (also referred to as "conveying roller A"), a third pair of conveying rollers 414

(also referred to as "conveying roller B1"), and a conveyance sensor 415 (also referred to as "conveying roller B2"). The paper conveyance unit 410 functions as the intermediate paper conveyance unit.

The paper introduction unit 416 functions as the intermediate paper introduction unit and introduces a plurality of papers including a paper that is discharged from the upstream apparatus 200 and the following paper Sn that follows the paper.

Each of the first to third pairs of conveying rollers 412, 413, and 414 is a pair of conveying rollers having an independent drive source and conveys the paper entering from the direction of the first pair of conveying rollers 412, to a pair of conveying rollers 538 (also referred to as "conveying roller C") of the paper conveyance unit 530. The pair of conveying rollers 538 is arranges at the paper conveying path in the vicinity of a connecting portion of a paper conveying path 411 and the paper conveying path of the paper conveyance unit 530. The conveyance sensor 415 detects the paper that passes the first pair of conveying roller 412. A paper discharge unit 417 discharges the plurality of papers that are conveyed by the paper conveyance unit 410.

<Control Method of Image Forming System 100>

The control unit 270 of the upstream apparatus 200 receives, from the client terminal of the user, print jobs, and based on the printing setting information included in the print jobs, sets various printing conditions. The control unit 270, based on, for example, the print gap of the printing setting information, sets the reference printing cycle. The control unit 270 continuously supplies, from the exterior paper feeder or paper feeding unit 220, the paper to the paper conveyance unit 230, in accordance with the set reference printing cycle, in the image forming unit 240, sequentially forms an image on the paper, and discharges the paper to the first intermediate conveying device 300. The paper that is discharged from the upstream apparatus 200 passes the first intermediate conveying device 300 and the second intermediate conveying device 400 and is conveyed to the downstream apparatus 500.

As illustrated in FIG. 16, in the downstream apparatus 500, the printing setting information is acquired and the standby of the printing operation is started (step S401). The control unit 570 receives, from the upstream apparatus 200, the printing setting information, makes preparations to perform printing (image formation) on each unit in the downstream apparatus 500 and waits.

Next, the preparation to receive the paper at the predetermined conveyance speed is made (step S402). The first intermediate conveying device 300 and the second intermediate conveying device 400 make preparations to receive the paper at the conveyance speed from the upstream apparatus 200.

Next, the entry of a first paper is detected (step S403). The control unit 570, based on the detection result of the detection sensor of the paper conveying path, detects the entry of the first paper S1 to the second intermediate conveying device 400.

Printing of a first paper is started and the printing cycle is set (step S404). The image forming unit 540 starts the image formation on the paper S1. The control unit 570 analyzes the received printing setting information and sets the printing cycle T that specifies the timing to start the image formation. More specifically, the control unit 570, based on the time tr at which the paper S1 arrives at the pair of resist rollers 536 and the print gap included in the printing setting information, sets the above described printing cycle T.

Then, monitoring of the delay of the following paper Sn is started (step S405). The control unit 570 monitors the delay of each of the following papers Sn that passes the conveyance sensor 415.

The entry of the following paper Sn is detected (step S406). The control unit 570, based on the detection result of the detection sensor of the paper conveying path, recognizes that the following paper Sn enters the second intermediate conveying device 400.

The delay time from the printing cycle T of the following paper Sn is calculated (step S407). With reference to the time tr at which the paper S1 arrives at the pair of resist rollers 536, based on a time at which the following paper Sn arrives at the pair of resist rollers 536, the delay from the printing cycle T of the following paper Sn is measured.

Whether the delay time exceeds the specified time is determined (step S408). The specified time is a time based on which the determination is made that if more delays are found, the influence on the productivity of the printing process of the downstream apparatus 500 is unacceptable. When the delay time does not exceed the specified time (step S408: NO), the paper conveyance is continued at the predetermined conveyance speed (step S409). On the other hand, when the delay time exceeds the specified time (step S408: YES), the speed is corrected and the paper conveyance is continued (step S412). In the present embodiment, the second intermediate conveying device 400 increases the conveyance speed of the following paper Sn by a speed corresponding to the delay time of the following paper Sn, and accordingly the delay time of the following paper Sn is solved or reduced. Details of the processes of correcting the speed and continuing the paper conveyance are described later.

Whether printings of the set number of copies are ended is determined (step S410). When the printings of the set number of copies are not ended (step S410: NO), the process proceeds to step S406.

On the other hand, when printings of the set number of copies are ended (step S410: YES), the printing operation is ended (step S411). The control unit 570 executes the process for ending the printing process and starts preparations for accepting the next print job. Then, the control unit 570 ends the control processing (End).

<Correct Speed and Continue Paper Conveyance>

Figure 17:
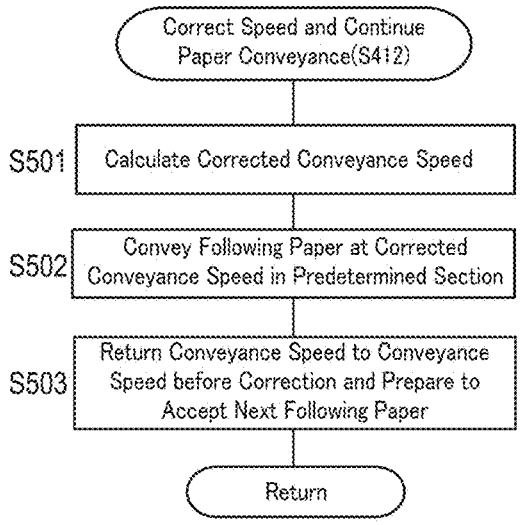
FIG. 17 is a subroutine flowchart for exemplifying the process of "correct speed and continue paper conveyance" in the flowchart illustrated in FIG. 16.
Figure 18:
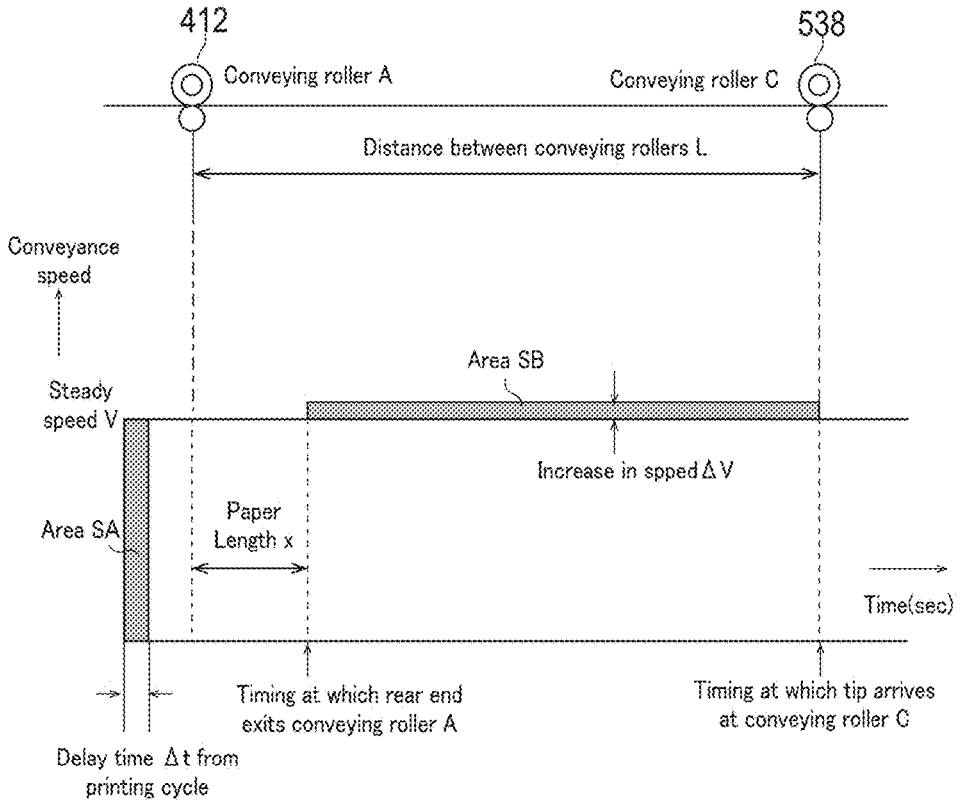
FIG. 18 is a schematic diagram exemplifying the process of calculating the corrected conveyance speed.

FIG. 17 is a subroutine flowchart for exemplifying the process (step S412) of "correct speed and continue paper conveyance" in the flowchart illustrated in FIG. 16, and FIG. 18 is a schematic diagram for illustrating the process of calculating the corrected conveyance speed.

As illustrated in FIG. 17, first, the corrected conveyance speed is calculated (step S501). As illustrated in FIG. 18, a steady speed before the correction is represented as v, the distance between the conveying roller A and the conveying roller C is represented as L, the length in the paper conveyance direction of the following paper Sn is represented as x, and the delay time from the printing cycle T of the following paper Sn is represented as Δt.

A conveyance delay amount w of the following paper Sn can be represented as below equation 1. The w corresponds to the area SA.

$$w = v \times \Delta t \quad \text{(Equation 1)}$$

The conveyance speed of the following paper Sn is increased from v to v+Δv and the recovery amount r can be represented as below equation 2. To simplify the descriptions, it is assumed that at the same time the rear end of the following paper Sn exits the conveying roller A, the speed increases by Δv, and at the same time the tip of the following paper Sn arrives at the conveying roller C, the speed is decreased by Δv. The r corresponds to the area SB.

$$r=(L-x)/v\times\Delta v \quad \text{(Equation 2)}$$

Assuming that the conveyance delay amount w is equal to the recovery amount r and solving v+Δv, the corrected speed v+Δv can be represented by below equation 3.

$$v+\Delta v=v\times\{1+(v\times\Delta t)/(L-x)\} \quad \text{(Equation 3)}$$

At the corrected conveyance speed, in the predetermined section, the following paper Sn is conveyed (step S502). The control unit 570 drives and rotates the first to third pairs of conveying rollers 412, 413, and 414 and accordingly, at the corrected speed, in the predetermined section, conveys the following paper Sn. The predetermined section corresponds to a distance from a position where the rear end of the following paper Sn exits the conveying roller A to a position where the tip of the following paper Sn arrives at the conveying roller C.

Then, the conveyance speed is returned to the conveyance speed before the correction and preparations are made to accept the next following paper Sn+1 (step S503). The control unit 570, at the conveyance speed from the upstream apparatus 200, makes preparations for accepting the next following paper Sn+1.

In this manner, in the processes of the flowchart of FIG. 16 and the subroutine flowchart of FIG. 17, when the delay time of the following paper Sn exceeds the specified time, in accordance with the delay time of the following paper Sn, the conveyance speed of the following paper Sn which is conveyed to the image forming unit 540 is changed. More specifically, from when the rear end of the following paper Sn exits the conveying roller A to when the tip arrives at the conveying roller C, the control unit 570 increases the conveyance speed of the following paper Sn by a speed corresponding to the delay time.

The image forming system 100 of the present embodiment described above yields following effects.

The image forming system 100, in accordance with the delay time of the following paper Sn, increases the conveyance speed of the following paper Sn which is conveyed to the image forming unit 540. Accordingly, even if, between the upstream apparatus 200 and the downstream apparatus 500, the information on the paper conveyance is blocked, while maintaining the productivity of the printing process, it is possible to prevent or suppress the deviation in the synchronization of the printing cycle. Accordingly, it is possible to prevent or suppress the accumulation and enlargement of the delays in the printing cycle of the downstream apparatus 500 and the occurrence of the defects in paper feeding.

As above, in the embodiments, the image forming system has been described. However, needless to say, the addition, the modification, and the omission can be appropriately made to the present invention by a person skilled in the art within a scope of a technical idea.

For example, in the first and second embodiments, descriptions are given for a case where the upstream apparatus and the downstream apparatus are image forming apparatuses. However, the present invention is not limited thereto, and for example, the upstream apparatus and the downstream apparatus may be any one of the paper feeder, a paper conveying device and the post-processing device.

Further, in the first embodiment, descriptions are given for a case where resuming of the conveyance of the following paper whose conveyance is stopped at the resist unit is advanced to solve or reduce the delay time of the following paper. However, the present invention is not limited thereto, and the present invention is applicable to a configuration in which a device is located at an upstream side in the paper conveyance direction of the paper processing unit, temporarily stops the paper conveyance to the paper processing unit, and then can control resuming.

The control program for the upstream apparatus and the control program for the downstream apparatus may be provided by computer-readable recording media such as a USB memory, a flexible disk, and a CD-ROM. Alternately, the control program for the upstream apparatus and the control program for the downstream apparatus, via the network such as Internet, may be provided online. In this case, the program recorded in the computer-readable recording media is generally transferred to the memory, the storage and the like to be stored therein. Further, the program may be, for example, provided as a single application software or as one function of the image forming apparatus, may be incorporated in the software of each device.

Although embodiments of the present invention have been described and illustrated in detail, the disclosed embodiments are made for purposes of illustration and example only and not limitation. The scope of the present invention should be interpreted by terns of the appended claims.

What is claimed is:

1. An image forming system comprising:

a first device that can continuously discharge a paper; and a second device that is located at a downstream side in a paper conveyance direction relative to the first device and is blocked from information on a paper conveyance in the first device, wherein the second device comprises:

a paper introducer that introduces a plurality of papers including a first paper that is discharged from the first device and a second paper that follows the first paper;

a control unit that acquires, from the first device, information on a printing setting of the paper;

a paper processor that performs a predetermined process on the paper; and a paper conveyer that includes a paper conveying path and conveys the paper, along the paper conveying path, from the paper introducer to the paper processor;

a paper detector that is located at a predetermined position on the paper conveying path that extends from the paper introducer to the paper processor and detects the paper that passes the predetermined position;

wherein the control unit is configured to:

set, based on information on a printing setting of the first paper and a time at which the first paper passes the predetermined position, a printing cycle that serve as a reference of a timing for the paper processor to start the predetermined process to the paper;

calculate, based on the printing cycle and a time at which the second paper passes the predetermined position, a delay time from the printing cycle of the second paper; and stop a conveyance of the second paper that is conveyed to the paper processor, and, in accordance with the delay time, control resuming of a stopped conveyance of the second paper; and wherein the control unit is further configured to, after stopping a conveyance of the second paper that is conveyed to the paper processor, when the delay time does not exceed a predetermined time, shorten a time until a stopped conveyance of the second paper is resumed by the delay time, resume the stopped conveyance of the second paper; and when the delay time exceeds the predetermined time, shorten a time until the stopped conveyance of the second paper is resumed by a first shortening time, resume the stopped conveyance of the second paper, and calculate a first carry-over time that is a time difference between the delay time and the first shortening time for storage.

2. The image forming system according to claim 1, wherein the paper conveyer conveys a third paper that follows the second paper to the paper processor from the paper introducer;

the control unit is configured to, based on the printing cycle and a time at which the third paper passes the predetermined position, calculate a delay time from the printing cycle of the third paper; and the control unit is configured to, after stopping a conveyance of the third paper that is conveyed to the paper processor, when a cumulative delay time that is a sum of the first carry-over time and the delay time does not exceed the predetermined time, shorten a time until a stopped conveyance of the third paper is resumed by the cumulative delay time and resume the stopped conveyance of the third paper, and when the cumulative delay time exceeds the predetermined time, shorten a time until the stopped conveyance of the third paper is resumed by a second shortening time, resume the stopped conveyance of the third paper, and calculate a second carry-over time that is a time difference between the cumulative delay time and the second shortening time.

3. The image forming system according to claim 2, wherein the paper conveyer includes a pair of resist rollers that is rotatably provided on the paper conveying path that extends from the predetermined position to the paper processor, and a pair of loop rollers that is rotatably provided on the paper conveying path that extends from the paper introducer to the predetermined position;

the control unit is configured to set the predetermined time to a loop keeping time for keeping a loop from when the loop is formed on the paper to when a conveyance of the paper is resumed between the pair of resist rollers and the pair of loop rollers; and the control unit is configured to set, when the cumulative delay time exceeds the predetermined time, between the pair of resist rollers and the pair of loop rollers, form the loop on the third paper, and then immediately resumes a conveyance of the third paper.

4. The image forming system according to claim 2, wherein the first device, at a frequency N (N is integer of 3 or more) set in advance, temporarily stops a conveyance of a paper;

the control unit is configured to, through information on the printing setting, acquire the frequency N from the first device;

the control unit is configured to, based on information on a printing setting of the Nth paper and a time at which the Nth paper passes the predetermined position, calculate a new printing cycle; and the control unit is configured to reset a cumulative delay time that is a sum of an N-2th carry-over time and a delay time of the Nth paper.

5. The image forming system according to claim 4, wherein the frequency N is configured in a changeable manner.

6. The image forming system according to claim 1, wherein the control unit is configured to, after stopping a conveyance of a kth (k is integer of 3 or more) paper that is conveyed to the paper processor, calculate a cumulative delay time that is a sum of a k-2th carry-over time and a delay time of the kth paper, when the cumulative delay time does not exceed the predetermined time, shorten a time until a stopped conveyance of the kth paper is resumed by the cumulative delay time and resume the stopped conveyance of the kth paper, and when the cumulative delay time exceeds the predetermined time, by incrementing the k, repeat operations of shortening a time until the stopped conveyance of the kth paper is resumed by a k-1th shortening time, resume the stopped conveyance of the kth paper, and calculate a k-1th carry-over time that is a time difference between the cumulative delay time and the k-1th shortening time for storage, until the cumulative delay time becomes zero or small.

7. The image forming system according to claim 1, wherein the paper conveyer includes a pair of resist rollers that is rotatably located on the paper conveying path that extends from the predetermined position to the paper processor and a pair of loop rollers that is rotatably located on the paper conveying path that extends from the paper introducer to the predetermined position; and the control unit is configured to set the predetermined time to a total time of a loop formation time for forming a loop on the paper between the pair of resist rollers and the pair of loop rollers, and a loop keeping time that is a time for keeping the loop from when the loop is formed to when a conveyance of the paper is resumed, stop a conveyance of the second paper that is conveyed to the paper processor by stopping a rotation of the pair of resist rollers, then resume a rotation of the pair of resist rollers to resume a conveyance of the second paper to the paper processor.

8. The image forming system according to claim 1, wherein the paper conveyer includes a pair of resist rollers that is rotatably provided on the paper conveying path that extends from the predetermined position to the paper processor, and a pair of loop rollers that is rotatably provided on the paper conveying path that extends from the paper introducer to the predetermined position;

control unit is configured to set the predetermined time to a loop keeping time for keeping a loop from when the loop is formed on the paper to when a conveyance of the paper is resumed between the pair of resist rollers and the pair of loop rollers, stop a conveyance of the second paper that is conveyed to the paper processor by stopping a rotation of the pair of resist rollers, then resume a rotation of the pair of resist rollers to resume a conveyance of the second paper to the paper processor.

9. The image forming system according to claim 8, wherein the control unit is configured to, when the delay time is equal to the predetermined time, between the pair of resist rollers and the pair of loop rollers, after forming a loop on the second paper, upon ensuring a requisite minimum time as a time for keeping the loop, control resuming of the stopped conveyance of the second paper.

10. The image forming system according to claim 1, wherein the first device is at least one selected from a group consisting of a paper feeder, an image forming apparatus, a paper conveying device and a post-processing device.

11. An image forming system comprising:

a first device that can continuously discharge a paper; and a second device that is located at a downstream side in a paper conveyance direction relative to the first device and is blocked from information on a paper conveyance in the first device, wherein the second device comprises:

a paper introducer that introduces a plurality of papers including a first paper that is discharged from the first device and a second paper that follows the first paper;

a control unit that acquires, from the first device, information on a printing setting of the paper;

a paper processor that performs a predetermined process on the paper;

a paper conveyer that includes a paper conveying path and conveys the paper, along the paper conveying path, from the paper introducer to the paper processor; and a paper detector that is provided on a predetermined position of the paper conveying path that extends from the paper introducer to the paper processor and detects the paper that passes the predetermined position;

wherein the control unit is configured to:

set, based on information on a printing setting of the first paper and a time at which the first paper passes the predetermined position, a printing cycle that serve as a reference of a timing for the paper processor to start the predetermined process on the paper;

calculate, based on the printing cycle and a time at which the second paper passes the predetermined position, a delay time from the printing cycle of the second paper; and change, in accordance with the delay time, a conveyance speed of the second paper that is conveyed to the paper processor;

the paper conveyer comprises a plurality of pairs of conveying rollers that are provided along the paper conveying path that extends from the predetermined position to the paper processor and are driven by each independent drive source; and the control unit is configured to rotate the plurality of pairs of conveying rollers to increase a conveyance speed of the second paper so that the paper processor synchronizes with the printing cycle and can start the predetermined process on the second paper.

12. An image forming system comprising:

a first device that can continuously discharge a paper, a second device that is located at a downstream side in a paper conveyance direction relative to the first device and is blocked from information on a paper conveyance in the first device, and an intermediate conveying device that is located between the first device and the second device, wherein the intermediate conveying device comprises:

an intermediate paper introducer that introduces a plurality of papers including a first paper that is discharged from the first device and a second paper that follows the first paper;

a paper discharger that discharges the plurality of papers;

an intermediate paper conveyer that includes an intermediate paper conveying path and a plurality of pairs of conveying rollers that are provided on the intermediate paper conveying path and are driven by each independent drive source, and conveys the paper, along the intermediate paper conveying path, from the intermediate paper introducer to the paper discharger; and a paper detector that is provided on a predetermined position of the intermediate paper conveying path that extends from the intermediate paper introducer to the paper discharger and detects the paper that passes the predetermined position; and the second device comprises:

a paper introducer that introduces the plurality of papers that are discharged from the intermediate conveying device;

a control unit that acquires, from the first device, information on a printing setting of the paper;

a paper processor that performs a predetermined process on the paper;

a paper conveyer that includes a paper conveying path and conveys the paper, along the paper conveying path, from the paper introducer to the paper processor;

wherein the control unit is configured to:

calculate, based on information on a printing setting of the first paper and a time at which the first paper passes the predetermined position, a printing cycle that serve as a reference of a timing for the paper processor to start the predetermined process on the paper;

calculate, based on the printing cycle and a time at which the second paper passes the predetermined position, a delay time from the printing cycle of the second paper; and rotate the plurality of pairs of conveying rollers to increase a conveyance speed of the second paper so that the paper processor synchronizes with the printing cycle and can start the predetermined process on the second paper;

the paper conveyer comprises a plurality of pairs of conveying rollers that are provided along the paper conveying path that extends from the predetermined position to the paper processor and are driven by each independent drive source; and the control unit is configured to rotate the plurality of pairs of conveying rollers to increase a conveyance speed of the second paper so that the paper processor synchronizes with the printing cycle and can start the predetermined process on the second paper.

* * * * *